US005907748A

United States Patent [19]

Kawana

[11] Patent Number: 5,907,748

[45] Date of Patent: May 25, 1999

[54] ELECTRICAL CONNECTOR, PROCESS CARTRIDGE AND ELECTROPHOTOGRAPHIC IMAGE FORMING APPARATUS

[75] Inventor: Takashi Kawana, Yokohama, Japan

[73] Assignee: Canon Kabushiki Kaisha, Japan

[21] Appl. No.: 08/898,575

[22] Filed: Jul. 22, 1997

[30] Foreign Application Priority Data

Jul. 24, 1996 [JP] Japan ..... 8-214224

[51] Int. Cl.[6] ..... G03G 15/00; G03G 21/18

[52] U.S. Cl. ..... 399/111; 399/25; 399/90; 439/70

[58] Field of Search ..... 399/90, 111, 119, 399/125, 25, 27, 28; 174/51, 59, 60; 439/70, 526, 924.1, 188

[56] References Cited

U.S. PATENT DOCUMENTS

| | | | |
|---|---|---|---|
| 3,408,612 | 10/1968 | Bute et al. | 439/68 |
| 4,084,869 | 4/1978 | Yen | 439/70 |
| 4,510,553 | 4/1985 | Faultersack | 439/924.1 X |
| 4,702,706 | 10/1987 | Sadigh-Behzadi | 439/69 |
| 4,746,310 | 5/1988 | Morse et al. | 439/620 |
| 4,961,088 | 10/1990 | Gilliland et al. | 399/25 |
| 5,208,529 | 5/1993 | Tsurishima et al. | 439/70 X |
| 5,272,503 | 12/1993 | LeSueur et al. | 347/25 |
| 5,452,059 | 9/1995 | Sekiya | 399/25 |
| 5,506,611 | 4/1996 | Jjita et al. | 347/86 |
| 5,699,091 | 12/1997 | Bullock et al. | 399/90 X |

FOREIGN PATENT DOCUMENTS

| | | |
|---|---|---|
| 0 386 938 A2 | 9/1990 | European Pat. Off. . |
| 41 14921 A1 | 11/1992 | Germany . |
| 1-289078 | 11/1989 | Japan . |
| 6-035264 | 2/1994 | Japan . |
| 88/09573 | 12/1988 | WIPO . |

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

An electrical connector for an electrophotographic image forming apparatus includes memory; a socket having the memory; plural electric contacts electrically connected with a contact of the memory; a short-circuit contact short-circuited with at least one of the electric contacts.

57 Claims, 17 Drawing Sheets

ELECTRICAL CONNECTOR, PROCESS CARTRIDGE AND ELECTROPHOTOGRAPHIC IMAGE FORMING APPARATUS

FIELD OF THE INVENTION AND RELATED ART

The present invention relates to an electrical connector, a process cartridge, and an electrophotographic image forming apparatus.

In this specification an slectrophotographic image forming apparatus includes an electrophotographic copy machine, an electrophotographic printer (LED printer, laser beam printer, and the like) an electrophotographic facsimile apparatus, an electrophotographic word processor, and the like. Also in this specification, a process cartridge means such a process cartridge that is removably installable in the main assembly of an electrophotographic image forming apparatus, and integrally comprises an electrophotographic photosensitive member as well as a charging means, a developing means, and/or a cleaning means. It also means such a process cartridge that is removably installable in the main assembly of an image forming apparatus, and integrally comprises an electrophotographic photosensitive member, and at least a developing means.

Further, the present invention relates to any unit removably installable in the main assembly of an image forming apparatus. More specifically, it relates to any unit such as a developing device, a toner cartridge, a process cartridge, or the like, which is removably installable in the main assembly of an image forming apparatus.

It is common knowledge that some image forming apparat uses such as copy machines and laser beam printers, which employ an electrophotographic image formation process can be rendered maintenance-free with the use of a process cartridge which integrally comprises an electrophotographic photosensitive member, and one or a plurality of processing means, such as a cleaning unit or a development unit, which acts on the electrophotographic photosensitive member.

In the case of such an image forming apparatus as described above, after the functions of the structural components in a process cartridge deteriorate due to usage, the process cartridge is entirely replaced with a fresh process cartridge. This process cartridge replacement operation is an extremely simple operation comprising a step of opening the main assembly of the image forming apparatus, a step of removing the process cartridge with worn components out of the main assembly of the image forming apparatus, and a step of installing a fresh process cartridge in the main assembly of the image forming apparatus. Therefore, such an image forming apparatus can be easily maintained by a user alone.

Recently, the aforementioned conventional art has been further developed to improve the utility of the above described image forming apparatus. More specifically, it has been considered to add a data storing following to the above image forming apparatus.

Data regarding manufacturing conditions and the like are written into an electronic device such as a memory provided in a process cartridge, at the time of manufacturing or shipment, and when the process cartridge is installed in the main assembly of an image forming apparatus, the data is looked up by the image forming apparatus in order to carry out an image forming operation under the optimum condition for the process cartridge.

In order to add the above function to an image forming apparatus, it is necessary to mount an electronic device such as an EEPROM or the like in a unit such as a process cartridge which is removably installable in the image forming apparatus. As the means for mounting the electronic device in the process cartridge, it is conceivable to provide the process cartridge with a printed circuit on which electronic devices such as a memory, and a connector, have been mounted.

Generally, the aforementioned non-volatile memory and connector are mounted on the printed circuit provided in a process cartridge, along with the electrically functional components such as a diode, a resistor, or a condenser, which protects the IC from electrical surge.

SUMMARY OF THE INVENTION

A primary object of the present invention is to provide an electrical connector which makes it easier to mount a memory in a unit such as a process cartridge which is removably mountable in an image forming apparatus, as well as to provide a unit which is removably mountable in an image forming apparatus and comprises such an electrical connector, and an image forming apparatus compatible with such a unit.

Another object of the present invention is to provide an electrical connector which makes it possible to compactly mount a memory in a unit such as a process cartridge which is removably mountable in an image forming apparatus, as well as to provide a unit which is removably mountable in an image forming apparatus and comprises such an electrical connector, and an image forming apparatus compatible with such a unit.

Another object of the present invention is to provide an electrical connector which makes it possible to reliably establish electrical connection between a memory and the main assembly of an electrophotographic image forming apparatus, as well as to provide a unit which is removably mountable in an image forming apparatus, and an image forming apparatus compatible with such a unit.

Another object of the present invention is to provide an electrical connector comprising a memory, a unit comprising such an electrical connector, and an image forming apparatus compatible with such a unit.

According to an aspect of the present invention, there is provided an electrical connector electrically connectable with a main assembly connector provided in the main assembly of an electrophotographic image forming apparatus, comprising storing means for storing information; a plurality of electrical contacts for separably connecting with a contact of the main assembly connector, when they are connected electrically with the main assembly connector; wherein the storing means is electrically connected with each of the electrical contacts with lead lines.

According to another aspect of the present invention, an electrical connector comprises storing means for storing data, and a plurality of electrical terminals which are connected to, or disconnected from, the corresponding electrical terminals of the counterpart connector provided on the main assembly side of an image forming apparatus, wherein the storing means is electrically connected to each of the plurality of electrical terminals by a lead wire; and a unit removably installable in an image forming apparatus comprises such an electrical connector. Further, an image forming apparatus is rendered compatible with such a unit.

Another object of the present invention is to provide an electrical connector capable of signaling whether or not a removably installable process cartridge or the like has been installed in the main assembly of an image forming apparatus, a process cartridge comprising such an electrical connector, and an electrophotographic image forming apparatus compatible with such an electrical connector.

Another object of the present invention is to provide an electrical connector which is superior in terms of noise related characteristics to the electrical connectors based on the prior art, a process cartridge comprising such an electrical connector, and an sleectrophotographic image forming apparatus compatible with such an electrical connector.

Another object of the present invention is to provide an electrical connector in which one of the electrical terminals is rendered longer than the rest of the terminals, being enabled to make contact with its counterpart before the rest do with their counterparts, when the connector is engaged with the counterpart, and being enabled to be disconnected last from the counterpart, when the connector is disengaged from its counterpart, so that the static electricity accumulated on an electronic memory device can be discharged before the rest of the electrical terminals make their contacts; a unit comprising such an electrical connector; and an image forming apparatus compatible with such an electrical connector.

Another object of the present invention is to provide an electrical connector which increases reliability in image formation by turning off the electrical power to an electronic device, and preventing access to the electronic device, in order to protect the information stored in the electronic device, when a removably installable process cartridge or the like is removed from the apparatus main assembly;, a process cartridge comprising such am electrical connector; and an image forming apparatus compatible with such an electrical connector, Another object of the present invention is to provide: an electrical connector comprising: a memory; a socket for the memory; and a plurality of electrical terminals which come in contact with corresponding pins of the memory, wherein a pair among the plurality Of electrical terminals are directly connected to each other; a process cartridge comprising such an electrical connector; and an image forming apparatus compatible with such an electrical connector.

Another object of the present invention is to provide: an electrical connector comprising: a memory; a socket for the memory; a plurality of electrical terminals in contact with corresponding contact pins of the memory, wherein at least one of the plurality of electrical terminals is longer than the rest; a process cartridge comprising such an electrical connector; and an image forming apparatus compatible with such an electrical connector.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 25 is a block diagram which depicts the operation of the printer engine in the color laser beam printer in another embodiment of the present invention.

DESCRIPTION OF THE PREFERRED EMBODIMENT

Hereinafter, the desirable embodiment of an electrical connector in accordance with the present invention will be described in detail, along with a process cartridge comprising such an electrical connector and an image forming apparatus compatible with such an electrical connector, with reference to the appended drawings.

Embodiment 1

Figure 1:
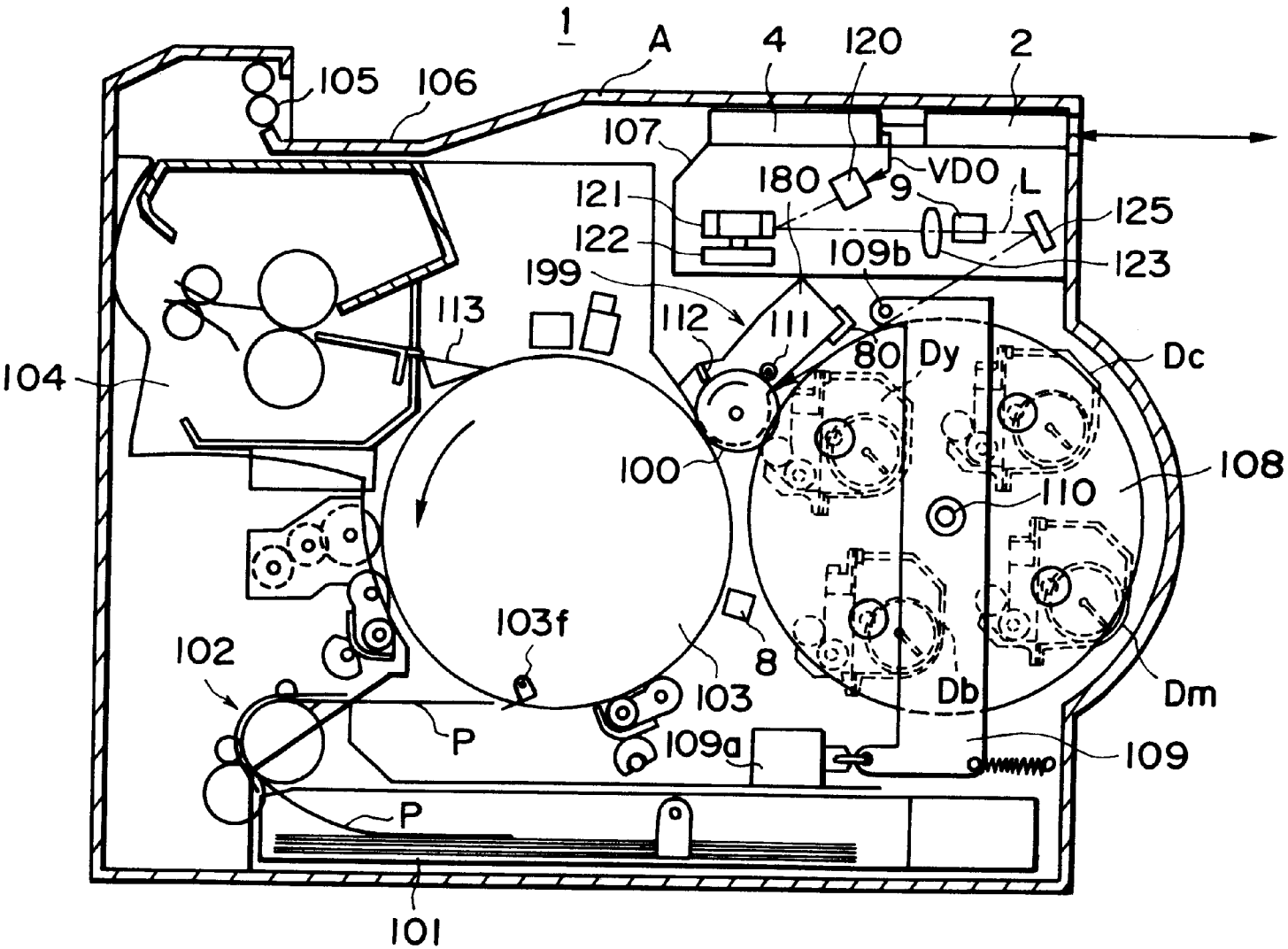
FIG. 1 is a schematic section of the image forming apparatus, that is, a color laser beam printer, in an embodiment of the present invention, depicting the general structure thereof

FIG. 1 is a section of an embodiment of a typical electrophotographic image forming apparatus 1, that is, a color laser beam printer (hereinafter, printers), in accordance with the present invention, depicting the general structure thereof, The printer in the drawing has a resolution of 600 dpi, and records color images based on multi-level data in which a picture element for each color component is expressed with eight bits. This color laser beam printer illustrated in FIG. 1 is also referred to in the following several embodiments of the present invention.

In the image forming apparatus illustrated in FIG. 1, a recording paper P fed from a sheet feeding section 101 by a conveying means 102 or the like is wrapped around the peripheral surface of a transfer drum 103 by a gripper 103f which grips the leading edge of the recording paper P. During this movement of the recording paper P, the leading edge of the recording paper P is detected by a detector 8, and a vertical synchronization signal (which will be described later) is generated based on the detection signal from the detector 8. The latent image, which is formed for each color component, on a drum-type electrophotographic photosensitive member 100 herainafter, "photosensitive drum") by an optical unit 107, is developed by a developing device Dy, Dc, Db, or Dm for the corresponding color component, and is transferred, in a superimposing manner, onto the recording paper P on the peripheral surface of the transfer drum 103, forming thereby a composite multicolor image: Thereafter, the recording paper P in separated from the transfer drum 103, and the multicolor image is fixed to the recording paper P in a fixing unit 104. Then, the recording paper P is discharged into a delivery 106 from a paper discharge section 105 as conveying means.

The developing device Dy, Dc, Db, or Dm has a rotational axis on both lateral surfaces, and is rotatively supported by a developing device selector mechanism 108. With this arrangement, the developing devices Dy, Dc, Db or Dm is enabled to face always the same direction even though the developing device selector mechanism 108 is rotated about a rotational axis 110. After a selected developing device is moved to the developing position, the frame 109 which holds the developing device selector mechanism 108 is pulled by a solenoid 109*a,* and as a result, the frame 109 is pivoted about a pivot 209*b,* moving thereby the developing device se lector mechanism 108 toward the photosensitive drum 100.

Next, the color image forming operation of a Color laser beam printer with the above described structure will be more specifically described.

First, the photosensitive drum 100 is uniformly charged to predetermined polarity by a charging device 111, and than is exposed to a laser beam L to form a latent image correspondent to, for example, a magenta color component on the photosensitive drum 100. The latent image correspondent to the magenta color component is developed by the developing device Dm, a developing device for magenta color. As a result, a first toner image, that is, a magenta color toner image is formed on the photosensitive drum 100. Meanwhile, a recording paper P is fed with a predetermined timing, and a transfer bias voltage (+1.8 kV) which has polarity opposite (for example, positive polarity) to the toner is applied to the transfer drum 103. As a result, the first toner image on the photosensitive drum 100 is transferred onto the recording paper P, and at the sane time, the recording paper P is electrostatically adhered to the peripheral surface of the transfer drum 103. Thereafter, the magenta color toner remaining on the photosensitive drum 100 is cleaned by a cleaner 112 to prepare the photosensitive drum 100 for the following latent image formation and the subsequent image development process. The toner removed from the photosensitive drum 100 is sent to a toner container 180 for the removed toner. The cleaner 112, the toner container 280 for the removed toner, the photosensitive drum 100, and the charging device 111 are integrated in the form of a process cartridge 199 (pohotosensitive drum cartridge) which is removably installed in the main assembly of the printer by an installing means 80.

Next, a latent image corresponding to a second color component, that is, the cyan color component, is formed on the photosensitive drum 100 by the laser beam L. This second latent image is developed by the developing device Dca the developing device for the cyan color component. As a result, a second color toner image of cyan color is formed on the photosensitive drum 100. The cyan colored second toner image is transferred onto the very recording paper P on which the magenta colored first toner image has just been transferred; it is superposed onto the magenta colored first toner image in alignment. therewith. During the transfer operation for the second toner image, a bias voltage of 2.1 kV is applied to the transfer drum 103 starting immediately before the recording paper P arrives at the transfer section.

Similarly and sequentially, third and fourth latent images for yellow and black color components, respectively, are formed on the photosensitive drum 100, are developed by the developing devices Dy and Db, respectively, into a yellow colored third toner image and a black colored fourth toner image, respectively, which are transferred onto the recording paper P in alignment with the toner images having been transferred onto the recording paper P. In other words, four toner images of different color are superposed on the recording paper P in alignment with each other. During the transfer operations for the third and fourth color toner images, bias voltages of +2.5 kV and +3.0 kV, respectively, are applied to the transfer drum 103 immediately before the recording paper P arrives at the transfer point.

The reason for increasing the transfer bias voltage after each toner image transfer is to prevent deterioration in transfer efficiency. The main cause of the transfer efficiency deterioration is accumulation of electrical charge on the recording paper. More specifically as the recording paper is separated from the photosensitive drum 100 after each image transfer, aerial discharge occurs between the recording paper and the photosensitive drum 100, charging the surface of the recording paper to the polarity opposite to the polarity of the transfer bias voltage (transfer drum which supports recording paper also is slightly charged). This charge having the polarity opposite to that of the transfer bias voltage is accumulated on the recording paper each time a toner image is transferred onto the recording paper. Therefore, the transfer electric field is weakened if the transfer bias is kept constant.

When the leading edge of the recording paper arrives at the starting point for the transfer inclusive of the adjacencies immediately before and after the starting point for the transfer) during the transfer operation for the fourth color, an effective AC voltage of 5.5 kV (frequency: 500 Hz), and a DC voltage of +3.0 kV, which is the same in polarity and potential as the transfer bias applied during the transfer of the fourth toner image transfer, are applied to the charger 111 in a superimposing manner. The reason for activating the charger III when the leading edge of the recording paper arrives at the transfer starting point is to prevent image anomaly related to toner image transfer. More specifically, in the case of a full-color image, even a slight transfer anomaly which may be inconspicuous in the case of a monochromatic image is liable to manifest conspicuously as substantial color difference. Therefore, it is necessary to apply a predetermined bias voltage to the charger 111 to cause electrical discharge.

Next, as the leading edge of the recording paper P, on which the four color toner images have been transferred in a superposing manner, approaches the separation point, the tip of a separation claw 113 comes in contact with the peripheral surface of the transfer drum 103, and separates the recording paper P from the transfer drum 103. The tip of the separation claw 123 remains in contact with the surface of the transfer drum 103 while separating the recording paper P from the transfer drum 103. After the separation of the recording paper P, the tip of the separation claw 113 moves away from the transfer drum 103 and returns to its home position. The charger 111 is kept activated from when the leading-edge of the recording paper arrives at the transfer starting point for the last color (fourth color) until when the trailing edge of the recording paper becomes separated from the transfer drum 103, to remove the charge (having the polarity opposite to the toner) accumulated on the recording paper, so that the recording paper separation by the separation claw 113 becomes easier, and also, so that the aerial discharge which occurs during the recording paper separation is reduced. The transfer bias voltage applied to the transfer drum 103 is turned off (reduced to the ground potential) when the trailing edge of the recording paper arrives at the transfer ending point (exit side of the nip formed at the contact between the photosensitive drum 100 and the transfer drum 103). At the same time, the bias voltage being applied to the charger III is turned off. Thereafter, the separated recording paper P is conveyed to a filing device 40, in which the toner image (images) on the recording paper P is fixed to the recording paper, and the recording paper is discharged into a delivery tray 106.

Next, the image forming operation based on laser beam scanning will be described.

In FIG. 1, a reference numeral 107 designates an optical unit which comprises a detector 9, a semiconductor laser 120, a polygon mirror 121, a scanner motor 122, a lens 123, and a mirror 125. In synchronism with the timing with which the leading edge of the recording paper 1 fed into the image forming apparatus is conveyed to the transfer drum 103, a batch of image signals VDO equivalent to a single page of recording paper is outputted to the semiconductor laser 120. Then, a light beam L modulated with the image signal VDO is projected from the semiconductor laser 120 toward the polygon mirror 121 being rotated by the scanner motor 122. Then, the light beam L is deflected by the polygon mirror 121, and is guided to the photosensitive drum 100 through the lens 123 and the mirror 125. Further, the light beam L is also detected by the detector 9 disposed on the main scanning axis, to output a BD (beam detection) signal, that is, a horizontal synchronization signal. The light beam L is oscillated in response to this horizontal synchronization signal, scanning, or exposing, the peripheral surface of the photosensitive drum 100. As a result, an electrostatic latent image is formed on the photosensitive drum 100.

The color laser beam printer in this embodiment outputs images at a resolution of 600 dpi through the image forming process described above.

As for the input data for this printer, the following image data are conceivable,; color image data (for example, data for RGB color components) generated by a host computer (hereinafter, "host"), image data which are stored in any given recording medium after being generated by image data generating apparatus (still image recorder or the like) other than the host computer; and the like. Therefore, this printer is provided with a printer controller which receives the image information from the host and generates image data, and a signal processing section which processes the image data.

In the following several embodiments, the input data for the printer are described as color image data.

Figure 2:
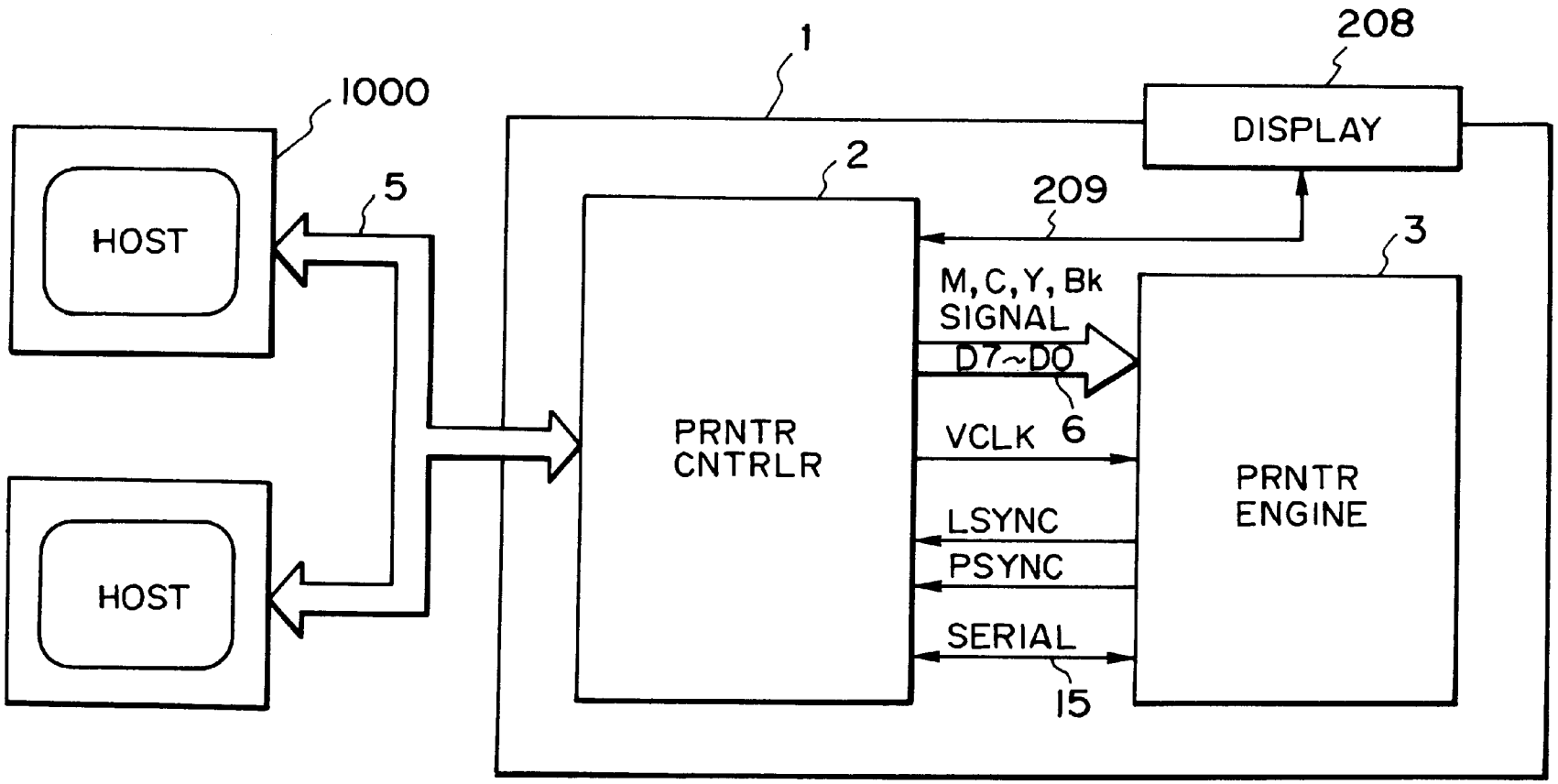
FIG. 2 is a block diagram which depicts the operation of the color beam printer illustrated in FIG. 1.

FIG. 2 is a block diagram of the operation of the printer I in accordance with the present invention. In FIG. 2, the printer 1 comprises the printer controller 2-and a printer engine 3. The printer controller 2 receives image information 5 expressed in a predetermined descriptive language, from a host 1000, and develops the image information 5 into a YMCBk image signal 6 in which each color is expressed by eight bits (D0–D7). Sometimes, the host 100 sends, as the image information 5, bit data such as RGB data read in through an image reader or the like. In such cases, the printer controller 2 processes the bit data without interpreting them In addition to the image signal 6, various other image signals are exchanged in the form of serial communication between the printer controller 2 and the printer engine 3. They are page synchronization signals PSYNC (scanning in the secondary direction), line synchronization signals LSYNC (scanning in the primary direction), and data transfer clock signals VCLK. The printer controller 2 outputs the image signal 6, that is, an eight bit signal, for each color component, in synchronism with the data transfer clock signal VCLX. Designated by reference numbers 208 and 209 are a display panel and a cable.

Figure 3:
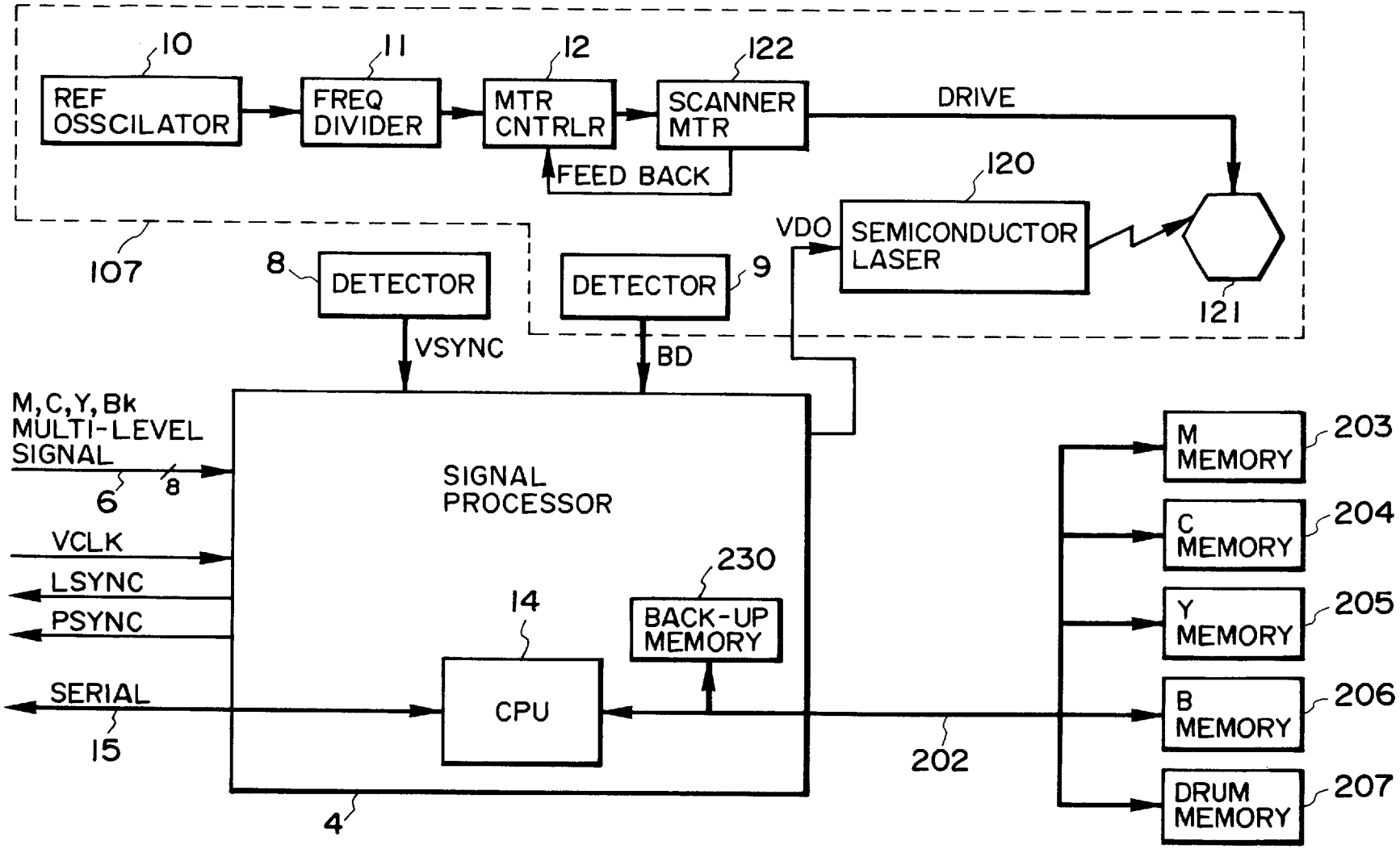
FIG. 3 is a block diagram which depicts the operation of the printer engine of the color laser beam printer illustrated in FIG. 1.

FIG. 3 is a block diagram of the operation of the printer engine 3 in accordance with the present invention In FIG. 3, the referential clock from a reference clock generator 10 included in the optical unit 107 is divided by a frequency divider 11. The scanner motor 122 is controlled by a motor control circuit 12 (contained in an unillustrated phase control circuit of a known type) so that it rotates at a constant speed, maintaining a predetermined phase difference between the divided reference clock and the feedback signal from the scanner motor 122. The rotation of the scanner motor 112 is transmitted to the polygon mirror 121, rotating the polygon mirror 121 at a constant speed.

On the other hand, as the transfer drum 103 is rotated by a motor (unillustrated) at a constant speed, the leading edge of the recording paper P on the transfer drum 103 is detected by the detector 8. As a result, a vertical synchronization signal VSYNC is sent to the signal processing section 4. Based on this vertical synchronization signal, the positioning of the leading edge of each color toner image is controlled in response to the vertical synchronization signal VSYNC. After the vertical synchronization signal VSYNC is outputted, the image signal VDO is sequentially sent to the semiconductor laser 120 in synchronization with the BD signal, as the horizontal synchronization signal HSYWC, generated by the detector 9.

A built-in CPU 14 of the signal processing section 4 exchanges control signals with the printer controller 2 in the form of serial communicator through a communication line 15, so that the operations of the printer controller 2 and the printer engines 3 remain synchronized. Further CPU 14 communicates with the memories 203–206 of the developing devices, the memory 207 of the photosensitive drum 100, and backup memory 230, through serial communication line 202. The memories 203–206 are EEPROMs, and are attached to the corresponding developing devices. The memory 207 is also an EEPROM, and is attached to a process cartridge, that is a photosensitive drum cartridge.

Figure 4:
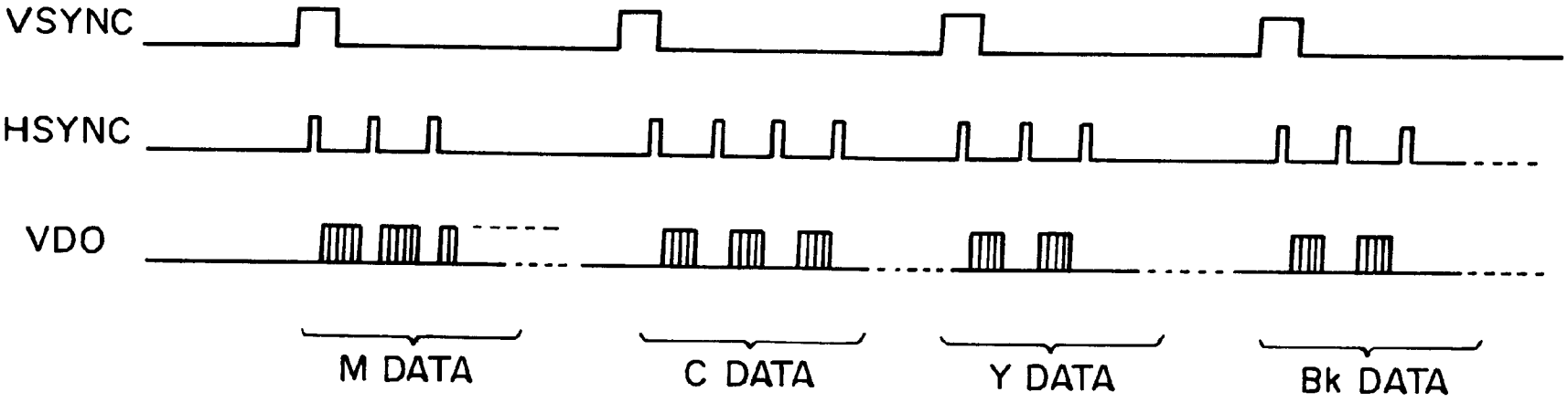
FIG. 4 is a timing chart for the image forming process of the color laser beam printer illustrated in FIG. 1, and depicts the relationship among a vertical synchronization signal (VSYNC), a horizontal synchronization signal (HSYNC), and a video signal (VDO).

The timing for the aforementioned vertical synchronization signal VSYCd, horizontal synchronization signal Y, and image signal VO is as shown in FIG. 4

Figure 5:
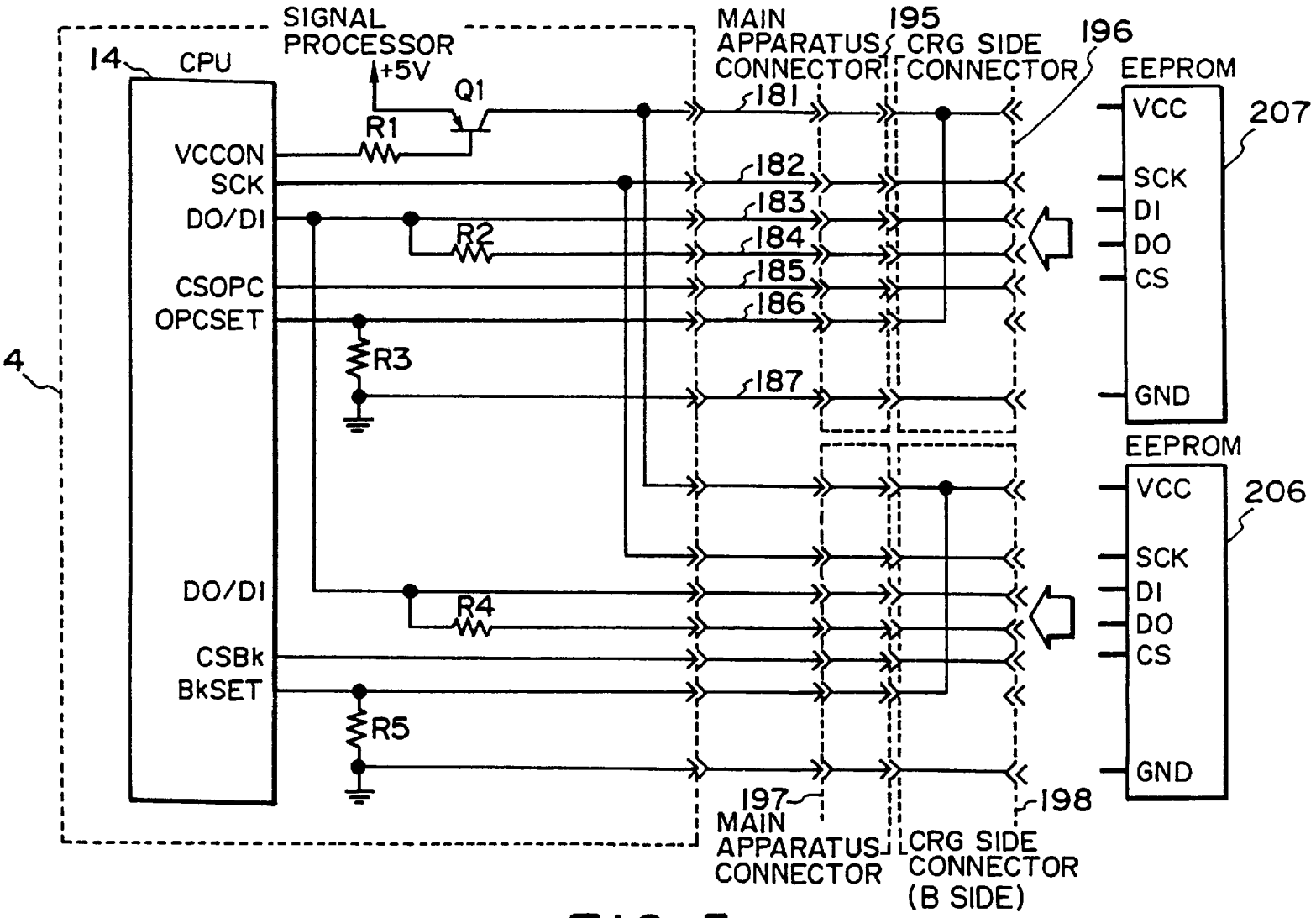
FIG. 5 is a circuit diagram which depicts signal exchange made among the signal processing section, the black color developing device, and the photosensitive drum memory, through the connector in one of the embodiments of the present invention.

FIG. 5 is a circuit diagram pertaining to the signal exchange between the signal processing section 4 and the memory 206 for the black color developing device, and between the signal processing section 4 and the memory 207 for the photosensitive drum.

Figure 8:
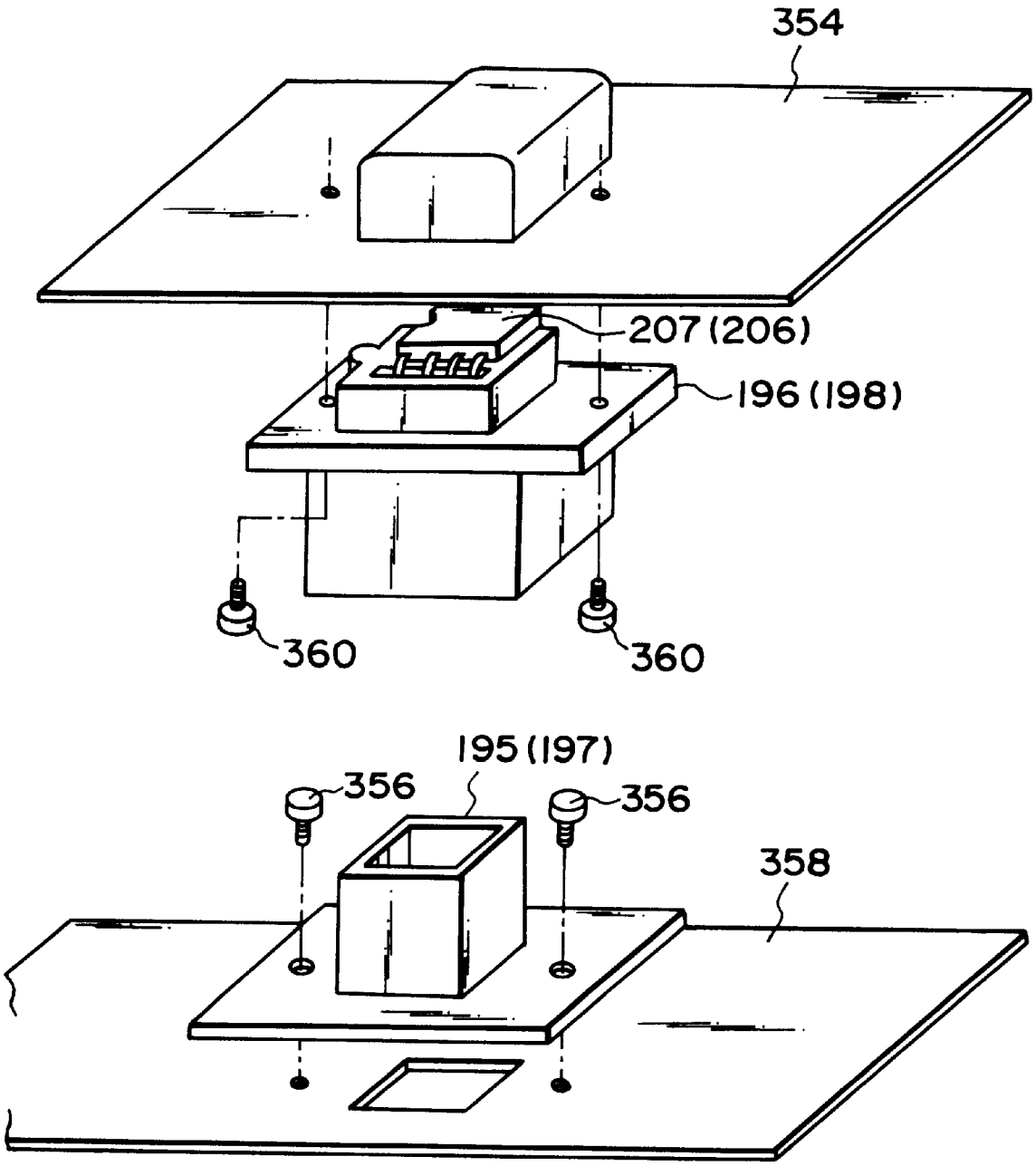
FIG. 8 is an exploded perspective view of an electrical connector in one of the embodiments of the present invention, illustrating the connector on the cartridge side and the connector on the main assembly side.

Referring to FIG. 8, one half of the connector 196 (first connector) on the photosensitive drum side (CRG side)

constitutes the main socket, and the other half constitutes the socket for an IC. The memory for the photosensitive drum, that is, the EEPROM 207, is indirectly attached to the photosensitive drum cartridge 199; it is inserted in the IC socket of the connector 196 attached to the photosensitive drum cartridge 199. Thus, as the connector 196 is fitted with the connector 195 (second connector) attached to the main assembly of the printers signals are enabled to be sent to the CPU 14 of the signal processing section 4. In this specification, "socket" means a member which supports the memory 207.

The voltage Voc supplied to the EEPROm 207 is turned on or off by-the CPU 14. When the VCCOW at the CPU port is LOS, the power source is ON, and when it is HIGH, the power source is OFF. The CPU 14 turns on the power supply during a read or write operation of the EEPROM. During a read operation, the CPU 14 reads a data signal 184 in synchronism with a clock signal 182, and during a write operation, it outputs a data signal 183, which is written into the EEPROM in synchronism with the clock signal 182. A signal 186 is a signal pertaining to the presence or absence of the photosensitive drum. When the level of the signal 186 is LOW, the CPU determines that a photosensitive drum cartridge is absent, and when the level of the signal 186 is HIGH, it determines that a photosensitive drum is present. More specifically regarding the level of the signal 186, as a photosensitive drum cartridge is inserted into the main assembly of the printer, the connectors 195 and 196 become engaged. Then, the voltage Vcc of the EEPROM is returned to raise the level of the signal 186 to HIGH.

The connector 198 on the CRG side is attached to the development cartridge for black color, with the EEPROM 206 for the developing device for black color being inserted in the socked thereof. Its signal exchange with the CPU is the same as the signal exchange of the photosensitive drum cartridge with the CPU.

Figure 6:
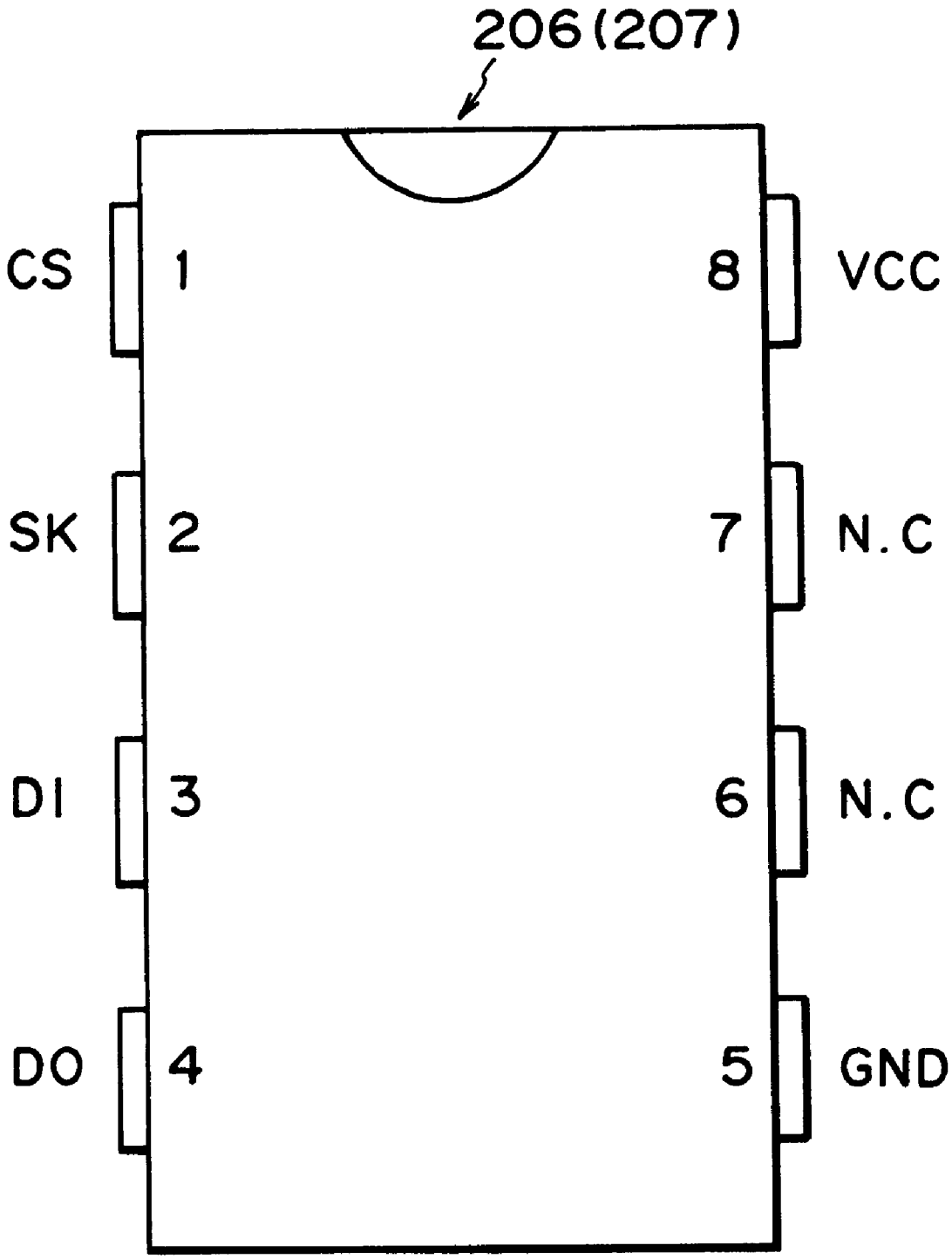
FIG. 6 is a schematic drawing of a Dip-type EEPROM-IC, showing the pin arrangement thereof.

The EEPROMs 207 and 206 both are Dip type ICs integrated circuits), and are directly connected to the connectors 196 and 198 on the CRG side, respectively. FIG. 6 shows an example of pin arrangement for a Dip type EEPOM-IC. Designated by R1 to R5 and Q1 are resistors and a transistor. Designated by CSOPC and NC are a ship selection signal and a non-contact pin. Designated by SCK, OPCSET, CSBK, BKSET and SK are an SCK port, an SCK port, an OPCSET port, a CSBK port, a BKSET port and an SK port.

Figure 7:
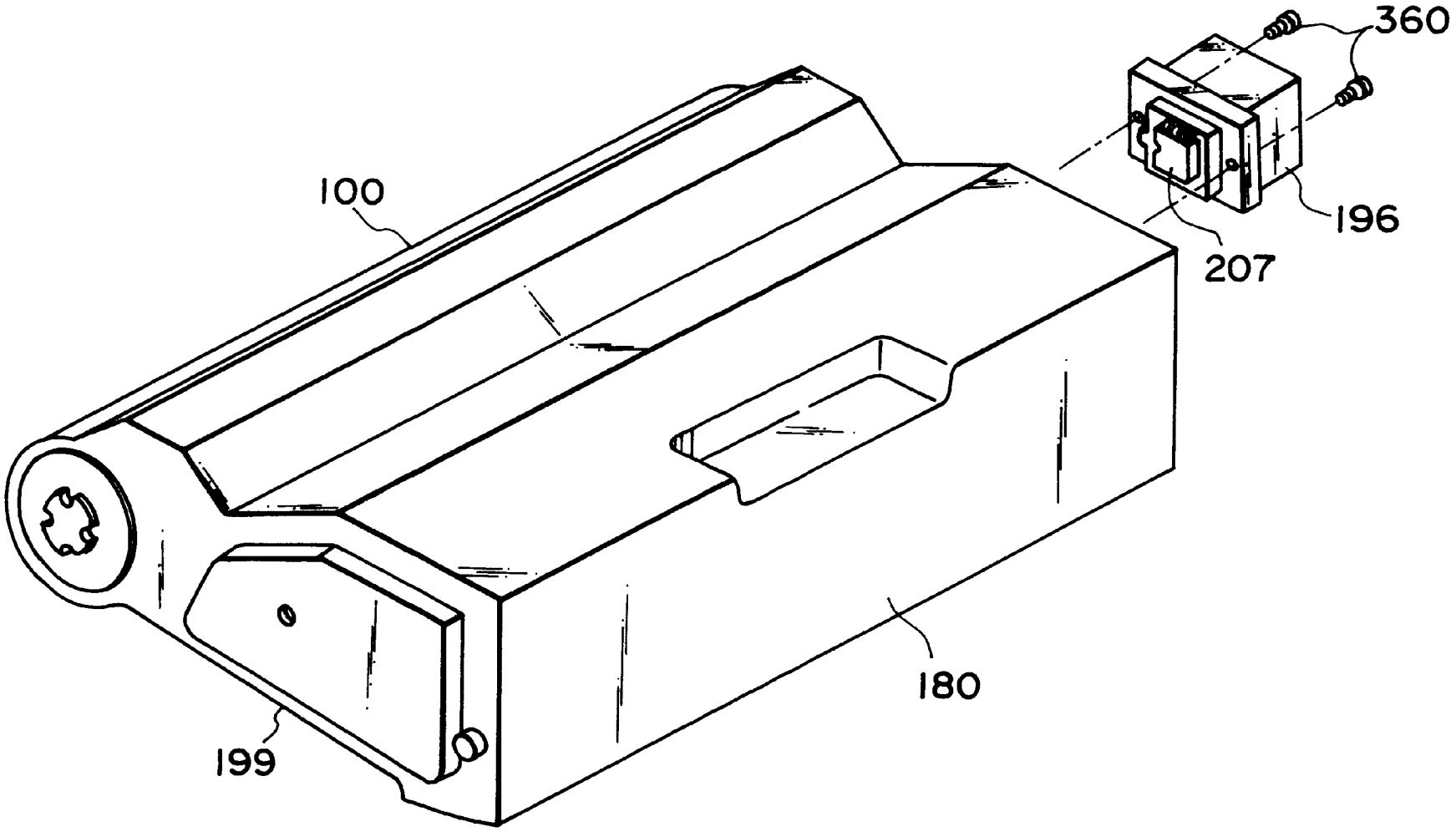
FIG. 7 is a perspective view of a process cartridge photosensitive drum cartridge).

FIG. 7 shows how the photosensitive drum cartridge 199, the EEPROM 207, and the connector 196 on the cartridge side, are put together. The photosensitive drum cartridge 199 comprises the photosensitive drum 100, the toner container 180 for the removed toner, the EEPROM 207, the connector 196 on the cartridge side,, and screws 360 for attaching the connector 196 to the cartridge 199.

FIG. 8 shows the configurations of the connector 196 (or 198) on the cartridge side, the connector 195 (or 197) on the main assembly side, and the EEPROM 207 (or 206). As is evident from the drawing, the connector 196 on the cartridge side is fixed to the connector mount portion 354 with the use of the screws 360. The connector 195 on the main assembly side is fixed to the mount portion 358 of the main assembly with the use of the screws 356.

Figure 9:
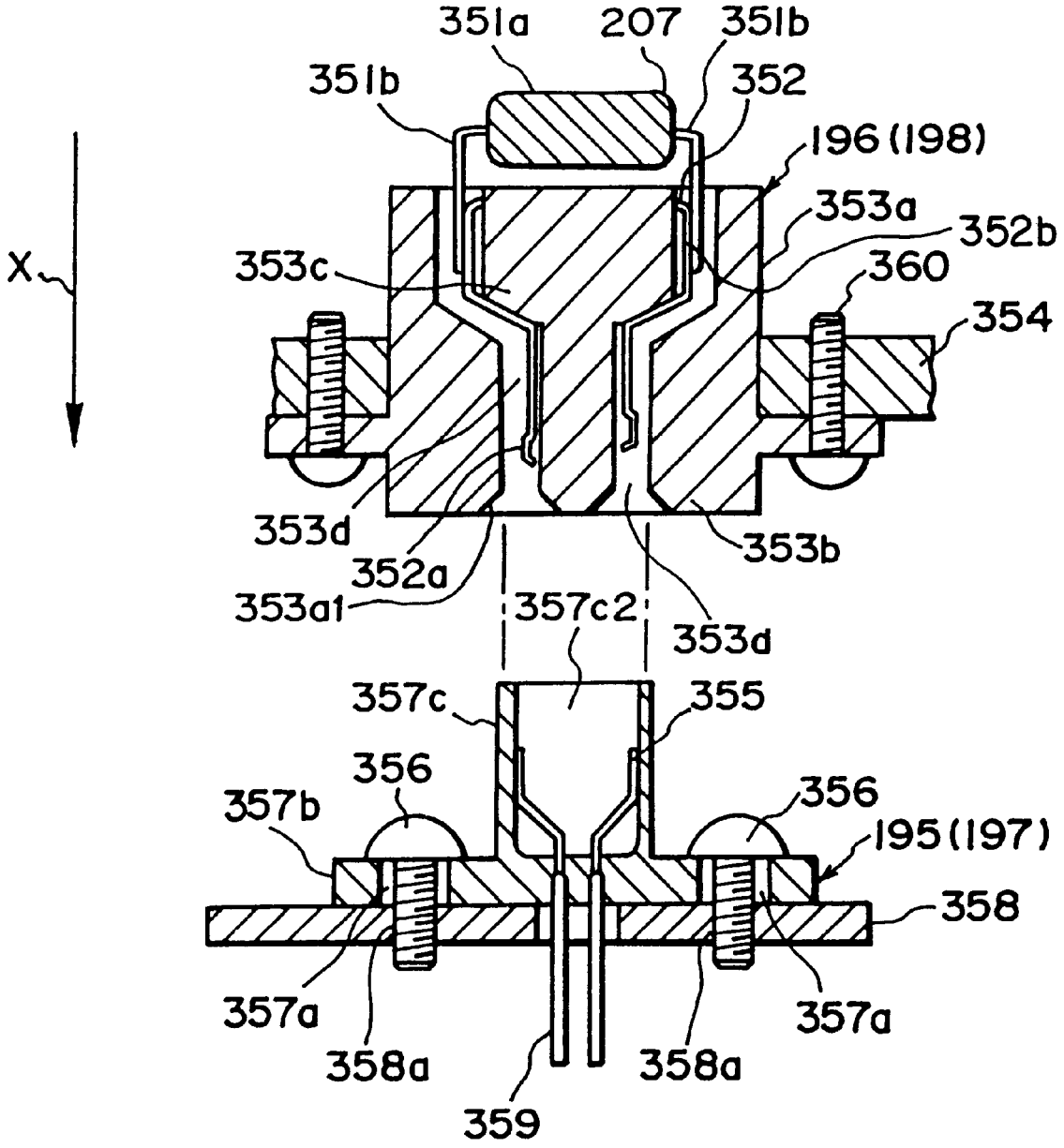
FIG. 9 is a section of the connector illustrated in FIG. 8.

FIG. 9 is a longitudinal section of the connector 196 (or 198) on the cartridge side, and the connector 195 (or 197) on the main assembly side, which are illustrated in FIG. 8.

In this embodiment, the connector main structure 196 (198) on the process cartridge side contains a contact 352 which is placed in contact with the IC 207 This connector main structure 196 (198) on the process cartridge side is fixed to the process cartridge. As for the connector main structure 195 (197) on the image forming apparatus main assembly side, which is the counterpart of the connector main structure 196 (198) on the process cartridge side, is fixed to the connector mount 358, that is, a part of the image forming apparatus main assembly, with the use of the small screw 356. However, since the connector main structure 196 (198) attached to the process cartridge B side is firmly fixed to the process cartridge B, it is necessary to make it sure that imperfect alignment between the process cartridge and the image forming apparatus main assembly does not generate stress in the connector main structures 196 (198) and 195 (197). Therefore, the connector main structure 195 (197) on the image forming apparatus main assembly side must be floatingly attached to the connector mount 358 of the image forming apparatus main assembly FIG. 9, a sectional view, depicts a connector designed in consideration of such a requirement. More specifically, the diameter of the hole 357*a* of the connector main structure 195 (197) on the image forming apparatus main assembly side is rendered slightly larger than that of the small screw 356 to create a gap large enough to compensate for the aforementioned misalignment. Therefore even though the small screw 356 is firmly screwed into the female screw threads 358*a* of the connector attachment portion 358 of the image forming apparatus main assembly, the connector main structure 195 (197) on the image forming apparatus main assembly side is floatingly attached to the connector mount 358 of the image forming apparatus main assembly A.

The connector main structure 196 (198) on the process cartridge side is formed of synthetic resin. It is hollow, and has a substantially square cross-section Its base side half (top side in the drawings) is larger than its engagement portion side (bottom side in the drawings). The internal space of the connector main structure on the process cartridge side is occupied by the IC mount 353*c*. The IC mount 353*c* is integrally formed with the connector mains structure 196 (198), or is first formed independently from the connector main structure 196 (198), and then attached to the external wall portion 353*a* and engagement portion wall 353*b* of the connector main structure 196 (198). The longitudinal section of the IC mount 353*c* is in the form of a character T as shown in FIG. 9. The surface of the IC mount 353*c* and the base side external wall 353*a,* and the surface of the IC mount 353*c* and the engagement portion side external wall 353*b,* form a continuous terminal mounting space 353*d* which opens outward at the top and bottom. The contact 352 exclusive of a portion 352*a,* the bottom end portion, is disposed in the IC mounting space, substantially in contact with the IC mount 353*c*. More specifically, in order to assure that the contact 352 is reliably placed in contact with the contact 355 on the image forming apparatus main assembly side, the bottom end of the contact 352 is bent outward to form the contact portion 352*a*. As for the IC 207, the main structure 352*a* of a chip is disposed directly above the IC mount 353*c,* with the provision of a predetermined gap. The lead wires pine 351*b* of the IC 207 are inserted from above into the electrode mounting space 353*d,* and made to directly press on the contact 352. The IC 207 is electrically connected to each of the contacts 352, by one of the lead wires 351*b*.

The connector main structure 195 (197) on the image forming apparatus main assembly side integrally comprises a mount portion 357*b* provided with the aforementioned hole 357*a* for the small screw, and an engagement portion 357*c* in the form of a rectangular parallelepiped. Wiring 359 is connected to a contact 355 fined to the connector main structure 195 (197) on the image forming apparatus main assembly side. The contact 355 is in contact with the internal surface of the engagement portion 357*c*. A reference symbol 357*c*2 designates a cavity provided in the engagement portion 357*c*. As the-process cartridge is inserted into the image forming apparatus main assembly the internal periphery 353*b* of the connector main structure 196 (198) on the process cartridge side fits against the external periphery 357*c* of the connector main structure 195 (197) on the image forming apparatus main assembly side, and the contact portion 352*a* of the contact 352 on the process cartridge side is pressed against the contact 355 on the image forming apparatus main assembly side, being elastically bent inward, and establishes electrical connection.

Figure 10:
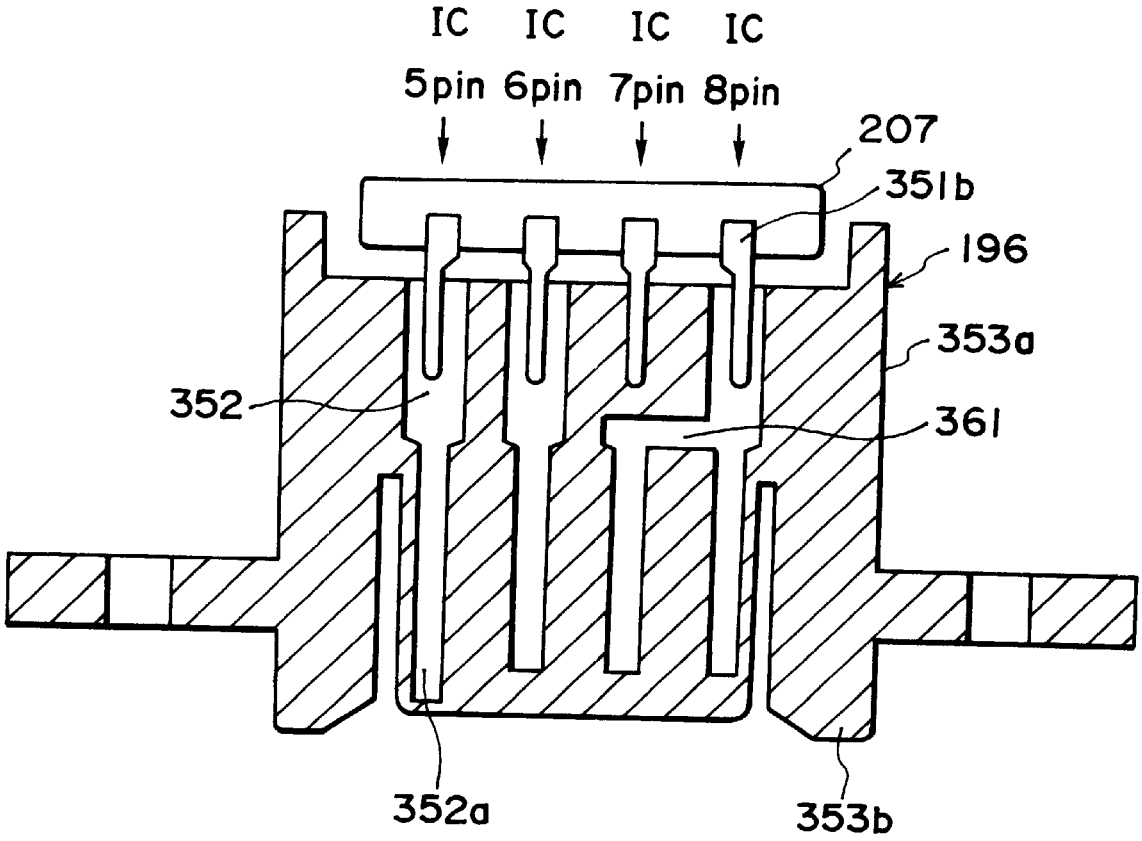
FIG. 10 is an enlarged section of the connector on the cartridge side.

FIG. 10 is a section of the connector 196 on the cartridge side, having been horizontally rotated 90 deg. from the position illustrated in FIG. 9; it is a sectional drawing at a plane passed through the fifth to eighth pins of the EEPROM IC. As shown in the drawing, no contact 352 is in connection with the seventh pin of the IC. The contact 352 connected to the eighth pin (electrical power source Vcc) of the IC branches into two (portion 361) portions which extend to the engagement portion 352*b*.

The contact corresponding to the fifth pin, the GHD pin, of the IC is rendered longer than the other contacts so that the contact corresponding to the fifth pin is first connected when the connector 196 is engaged with the connector 195, and is disconnected last when the connectors are disengaged. With this arrangement, even when the EEPROM-IC is statically charged, the static electricity is discharged through the GHD pin before the other contacts are connected to their counterparts, and therefore, the input/output port of an EEPROM is prevented from being damaged when the connectors are engaged.

In this embodiment, the present invention was described with reference to the photosensitive drum cartridge 199 as a process cartridge However, an EEPROM may be attached in the same manner as described above to the development toner cartridges containing magenta toner, cyan toner, yellow toner, or black toner. Further, the aforementioned connector and memory may be attached in the same manner to a process cartridge integrally which comprises a developing device containing developer, and a container for the toner removed from a photosensitive drum.

Also, the memory IC referred to in this embodiment was an EEPROD, but the present invention is compatible with nonvolatile memories of other types.

Figure 11:
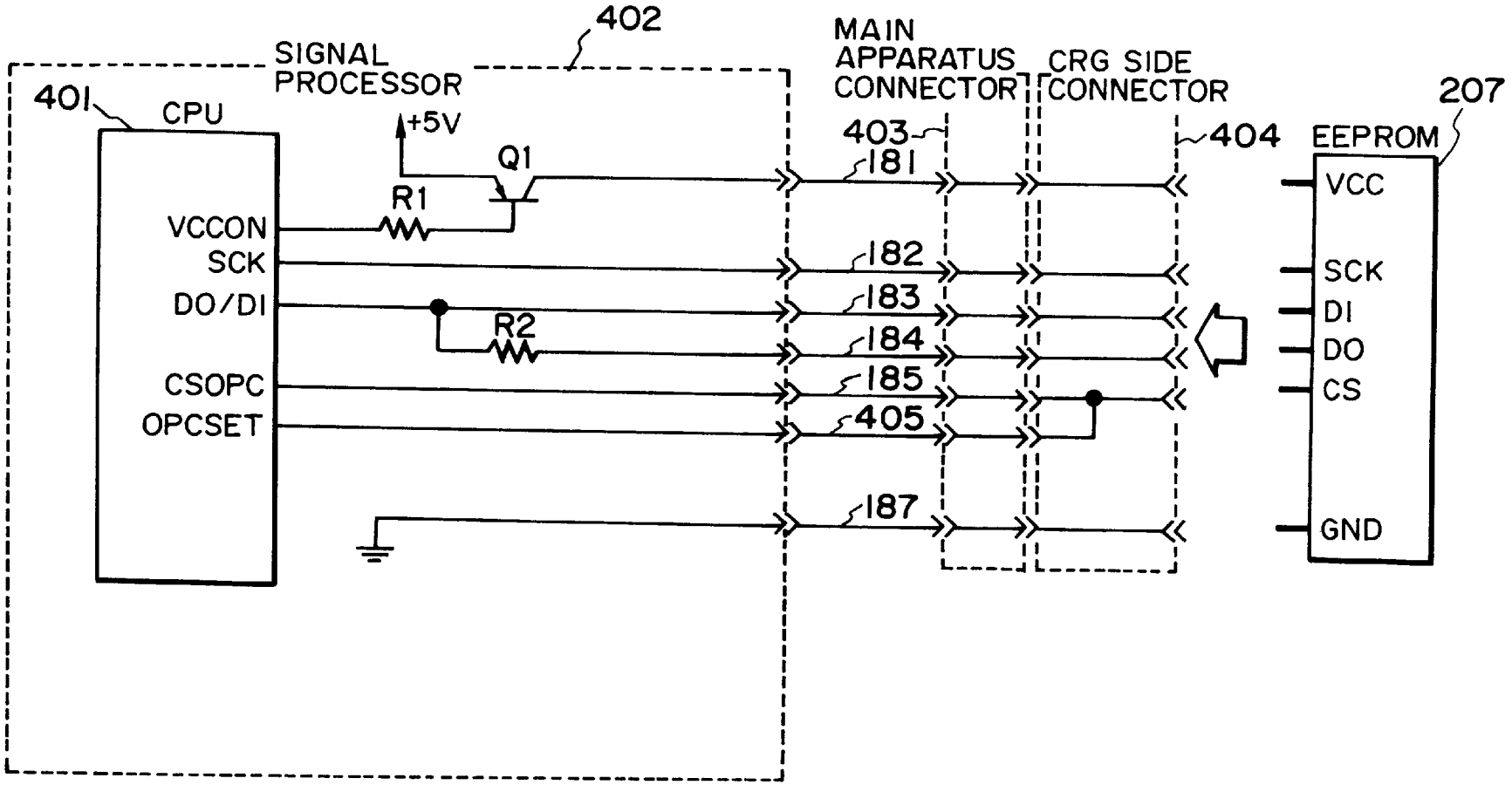
FIG. 11 is a circuit diagram which depicts the signal exchange made between the signal processing section and the memory of the photosensitive drum through the connector in another embodiment of the present invention.

Further, the voltage Vcc supplied to the EEPROM was returned to the main assembly side. However, the GND signal and the EEPROM control signal may be returned to the main assembly-side in the same manner. FIG. 11 depicts a structure by which a chip selection signal CS, that is, an EEPROM control signal, is returned to the main assembly side to detect whether or not a photosensitive drum cartridge is present. Designated by 405 is a signal indicative of presence or absence of the process cartridge. Reference numeral 401 designates a CPU and 402, 403 and 404 are the signal processor, the main apparatus connector and the cartridge side connector as shown in FIG. 11.

Embodiment 2

Figure 12:
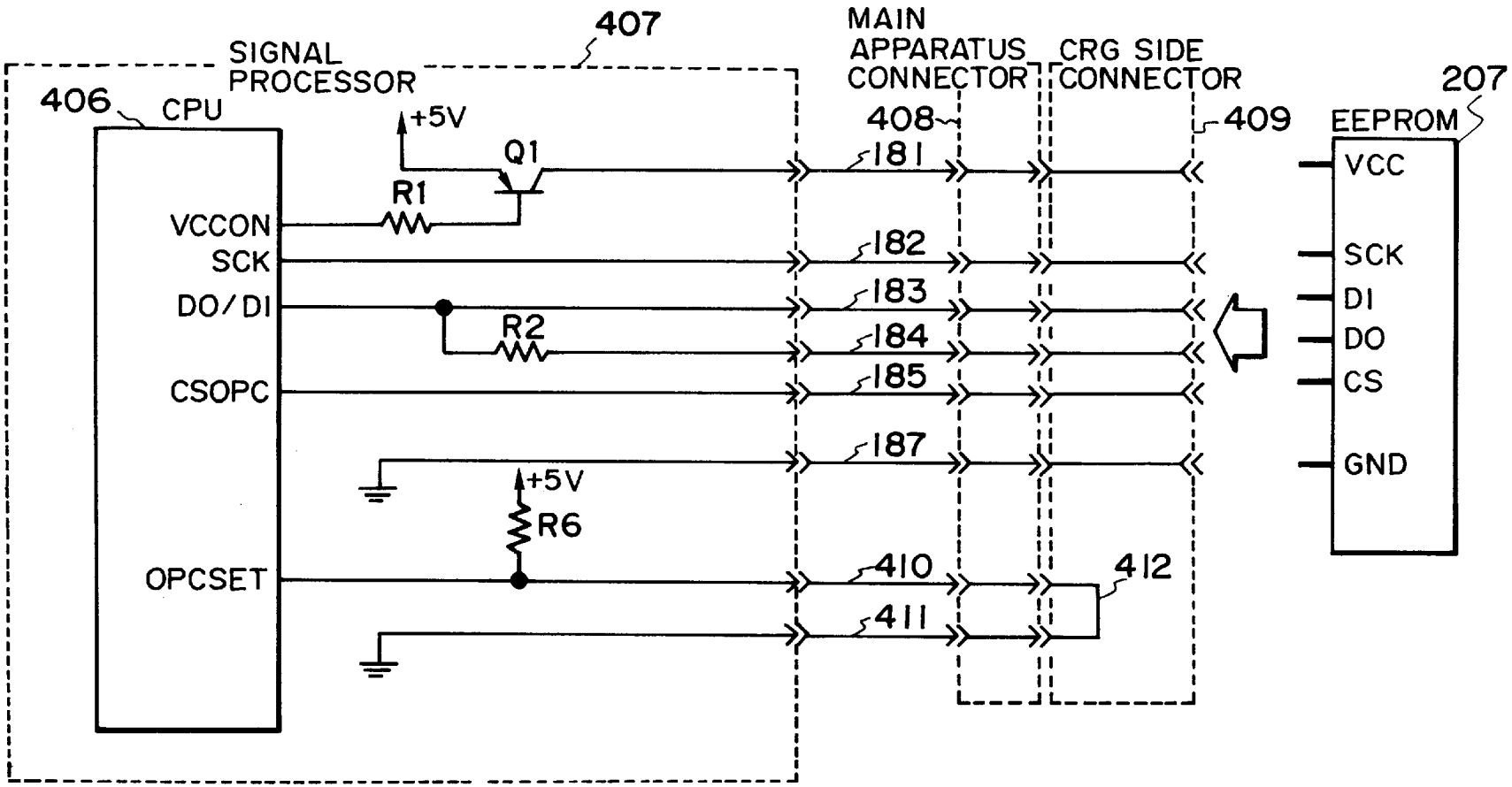
FIG. 12 is a circuit diagram which depicts the signal exchange made between the signal processing section and the photosensitive drum memory through the connector in another embodiment of the present invention.

FIG. 12 depicts the second embodiment of the present invention. It is a circuit diagram which shows the wiring placed between the CPU on the apparatus main assembly side and the EEPROM of a photosensitive drum to detect the presence (absence) of a photosensitive drum cartridge.

In this embodiment, the control signal of the EEPROM is not returned. Instead, two independent signal lines 410, 411 are added to the connector 409 on the cartridge side. When the connector 409 on the cartridge side is not in connection with the connector 408 on the main assembly side, a cartridge detection signal 410 is pulled up to a HIGH level by a resistor R6, and when the two connectors 409 and 408 are in connection, the cartridge detection signal 41-0 remains at a LOW level. Designated by 406 and 407 are the CPU and the signal processor, as shown in FIG. 12. Element 412 in FIG. 12 is a short circuit contact.

Figure 14:
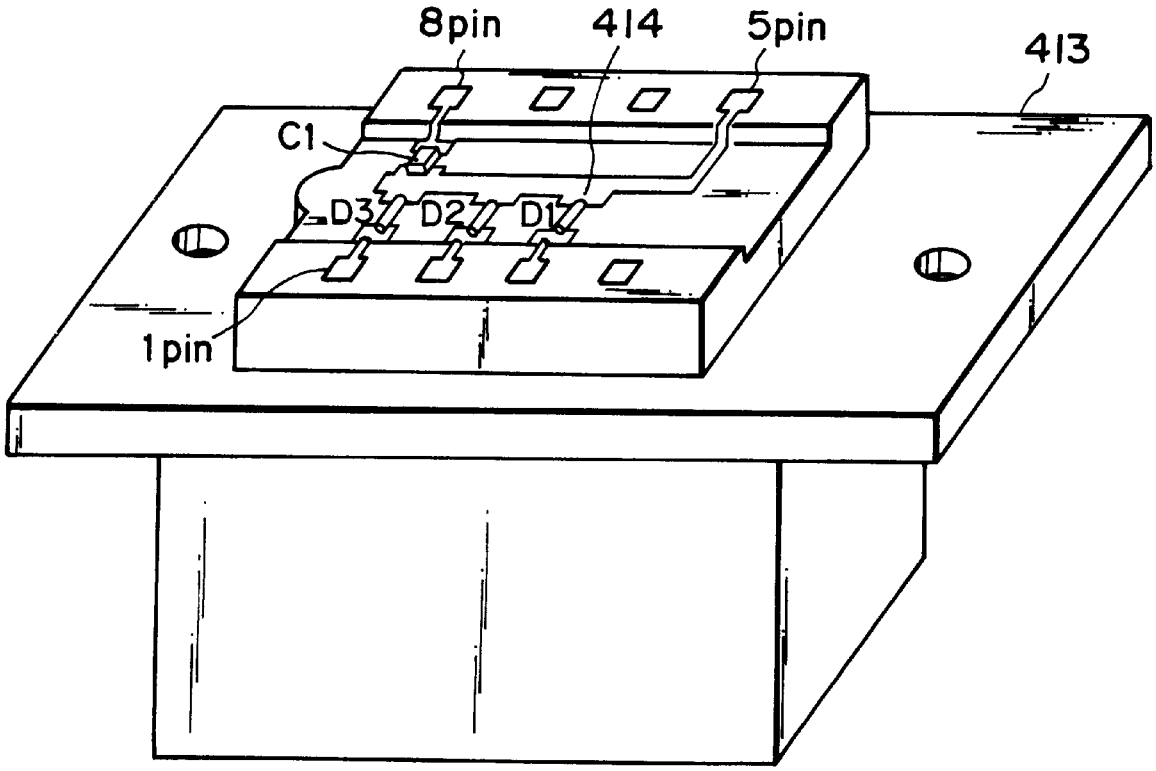
FIG. 14 is a perspective view of the connector on the cartridge side in one of the embodiments of the present invention.

FIG. 14 is an external perspective view of the connector 413 on the cartridge side in this embodiment. As shown in the drawing, a metallic plate 414 is extended from the fifth pin (GHD pin) of the IC socket, being indirectly connected to the first pin through a diode D3, to the second pin through a diode D2, to the third pin through a diode D1, and to the eighth pin through a condenser C1. The diodes D1–D3 and the condenser C1 are fixed to the metallic plate 414 by soldering. With this arrangement in place, an EEPROM is inserted from above into the IC socket.

According to this embodiment, connector reliability can be improved while maintaining low cost.

Embodiment 3

Figure 13:
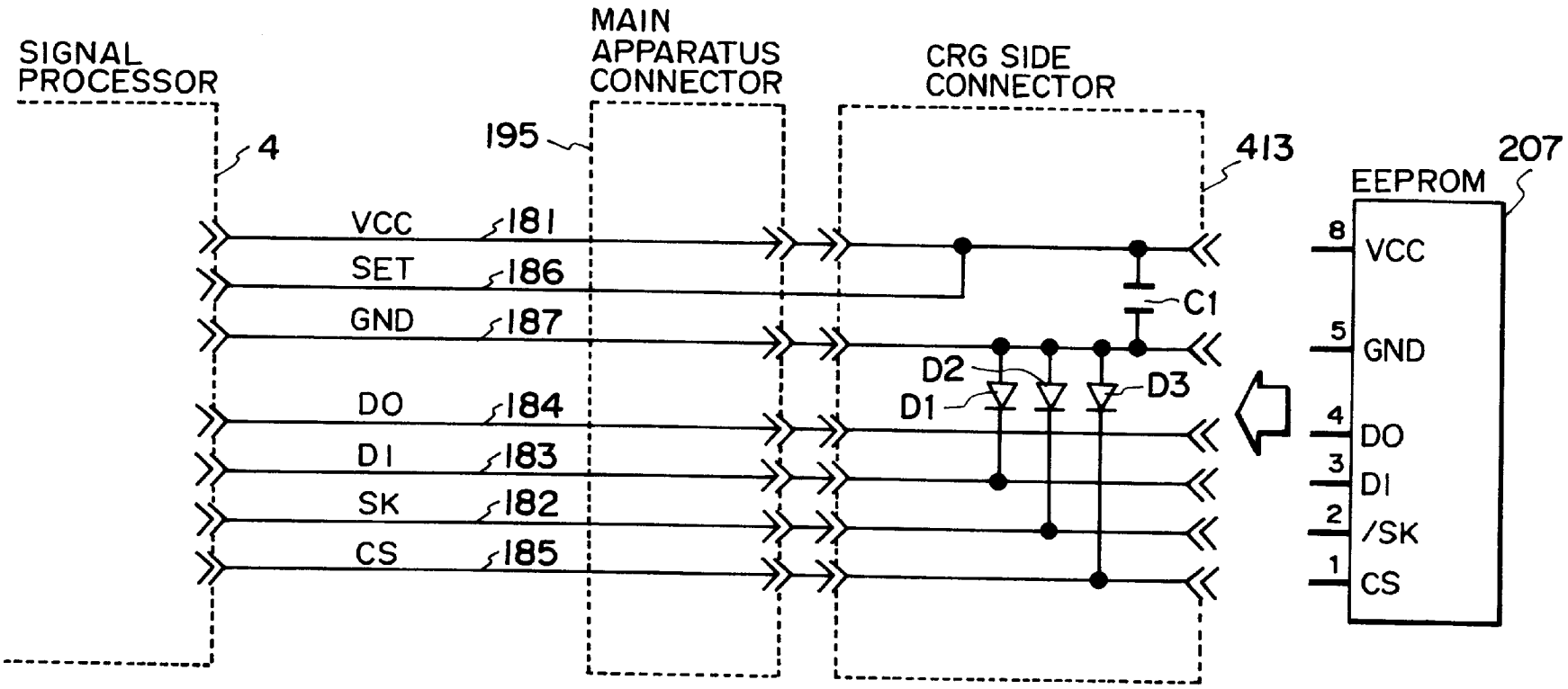
FIG. 13 is a circuit diagram which depicts the signal exchange made between the signal processing section and the photosensitive drum memory, in another embodiment of the present invention.

FIG. 13 depicts the third embodiment of the present invention. It shows the electrical connection between the signal processing section 4 of the main assembly of a prints, and the EEPROM of a cartridge. In this embodiment, the present invention is described with reference to only the EEPROM of a photosensitive drum cartridge. However, the same description applies to development toner cartridges for different colors.

The signal processing section 4, the connector 195 on the main assembly side, the EPEPROM 207, and the signal lines 181–187 in this embodiment are the same as those in the first embodiment. Built in this embodiment, a condenser C1 and diodes D1–D3 are mounted in the connector 413 on the cartridge side as shown in FIG. 13. The condenser C1 smoothes out the noise sent to the Vcc line from the EEPROM 207 during the programming of the EEPROM 207. It also absorbs the external static electricity which enters the Vcc line, so that the external static electricity does not affect the EEPROm. The diodes D1–D3 allows the internal static electricity, which enters the CS line, the SK line, and the DI line to be discharged through the GND line so that the EEPROM is not affected by the external static electricity.

Embodiment 4

Figure 15:
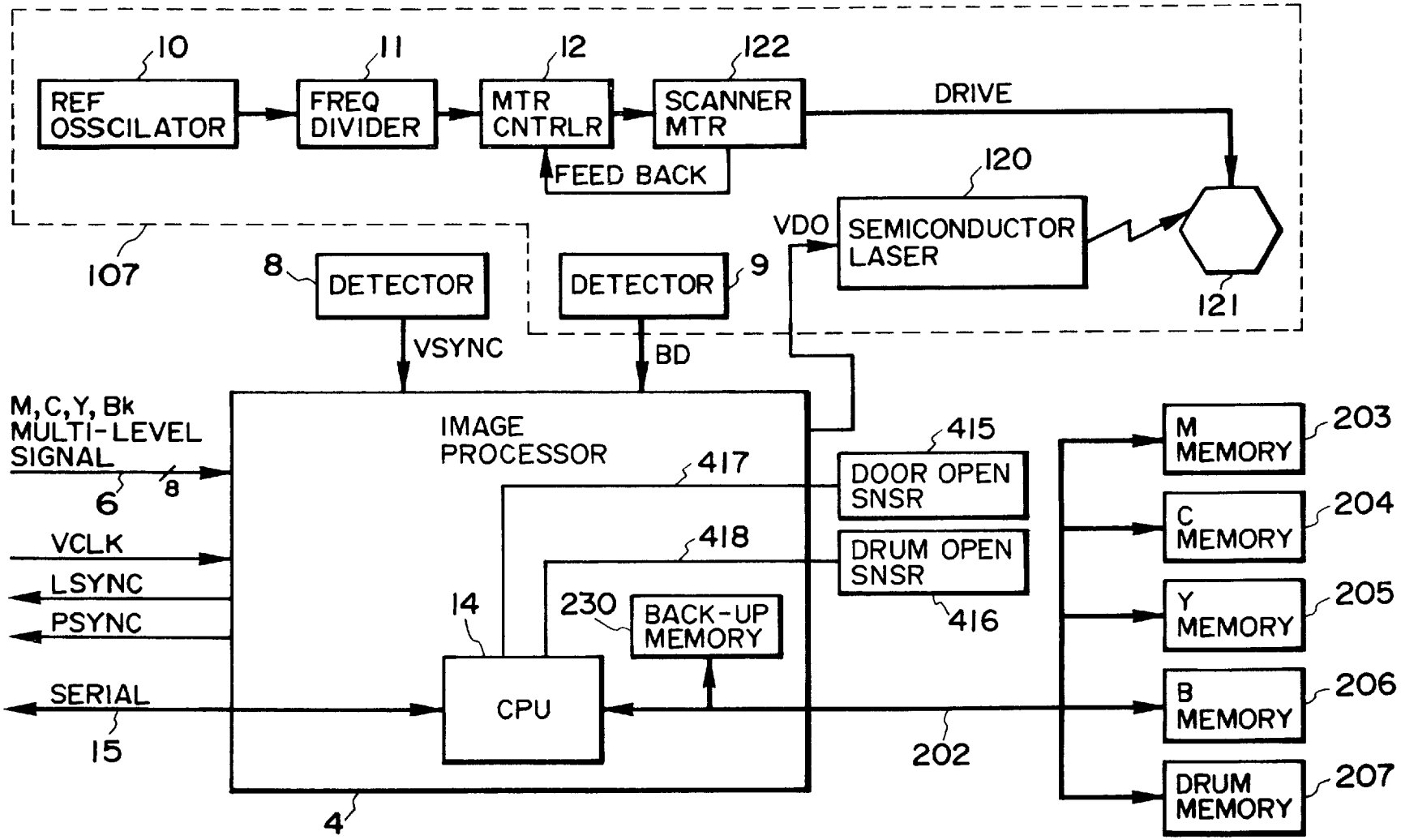
Figure 16:
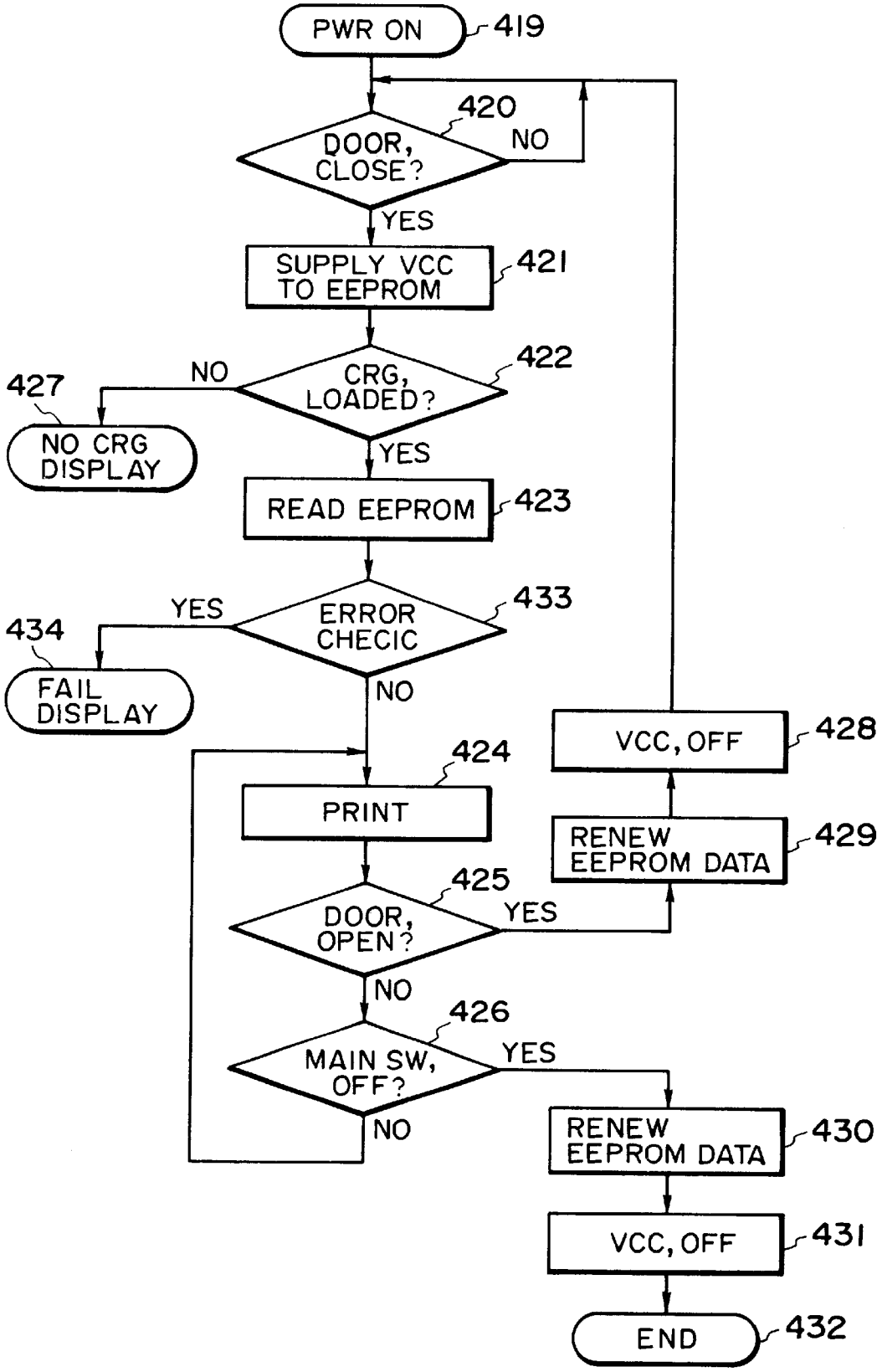
FIG. 16 is a flow chart which depicts the control executed by the CPU in one of the embodiments of the present invention.

FIG. 15 is a block diagram which depicts the electrical connection in the fourth embodiment of the present invention. FIG. 16 is a flow chart for the control executed by the CPU 14. In FIG. 15, the members having the same functions as those in the first embodiment are given the se referential numeral as the one used in the first embodiment.

In FIG. 15, a photosensitive drum door sensor 416 is a switch that detects the opening or closing of the door which occurs when a photosensitive drum cartridge is exchanged or removed. When a signal 418 outputted by this sensor 416 indicates that the door is open, the CPU 14 determines that the photosensitive drum cartridge is to be exchanged with a fresh one, or removed, and then updates the contents of the photosensitive drum memory 207. It is approximately one second or more from when the photosensitive drum door sensor 416 detects the opening of the door to when the photosensitive drum is removed by the user, that is, when the I/O of the photosensitive drum memory becomes disconnected from the main assembly of the printer. A developing device door sensor 415 is a switch which detects the opening or closing of the door when one or more of the developing devices or different color are exchanged or removed. When a signal 417 outputted by this sensor 417 indicates that the door is open, the CPU 14 determines that one or more of the developing devices are to be exchanged or removed, and updates the contents of the developing device memories 203, 204, 205 and/or 206. There will be approximately one second or more from when the developing device door sensor 145 detects the opening of the door to when one or more of the developing devices are removed by the user.

FIG. 16 is a flow chart for the control, in particular, the control for the photosensitive drum memory, executed by the CPU 14 as a photosensitive drum cassette is installed.

As the electrical power source of the main assembly of a printer is turned on (419), it is determined whether or not the photosensitive drum cartridge door is closed (420). When it is confirmed that the photosensitive drum cartridge door is closed, a voltage Vcc is supplied to the photosensitive drum memory 207 (421) to confirm (422) that a photosensitive drum cartridge is present (422). As for the method for confirming the presence of the photosensitive drum cartridge, confirmation is made eased on the logic level of the voltage Vcc of the return signal from the connector on the cartridge side. When it is confirmed that there is no cartridge, the absence of the cartridge is reported to the user through a display panel or a host computer (427). When it is confirmed that there is a cartridge, necessary information is read from the EEPROM, that is, the memory of the photosensitive drum (423). At this point, the printer enters a state of being on standby, or being ready for a printing operation. When the photosensitive drum cartridge door is not open (425) after a printing operation, the state of the main switch of the printer main assembly is checked (426) then the main switch is ON, the printer goes back to the state of being on standby (424) for the nest printing operation.

On the other hand, when the photosensitive drum cartridge door is open (425), the contents of the photosensitive drum memory 207 are updated (429), and the voltage Vcc is turned OFF (428).

When the main switch of the printer main assembly is OFF (426), the contents of the photosensitive drum-memory 207 are updated (430); the voltage Vcc is turned OFF (431); and the electrical power source for the entire printer is turned OFF (432).

It should be noted here that the information to be updated in the photosensitive drum memory 207 means, for example, the data pertaining to the remaining service life of the photosensitive drum, the number of the sheets printed, and the like.

Embodiment 5

In each of the first to fourth embodiments, cases in which the present invention was applied to the color laser beam printer in which a plurality of toner images formed on the photosensitive drum 100 are transferred onto the recording paper P carried on the peripheral surface of the transfer drum 103 were described. However, in this embodiment, the present invention is applied to a color laser beam printer, illustrated in FIG. 17, in which a plurality of toner images formed on a photosensitive drum 71 are temporarily transferred onto an intermediary transfer unit, and then, all the toner images on the intermediary transfer unit are transferred all at once onto a recording paper P.

Figure 17:
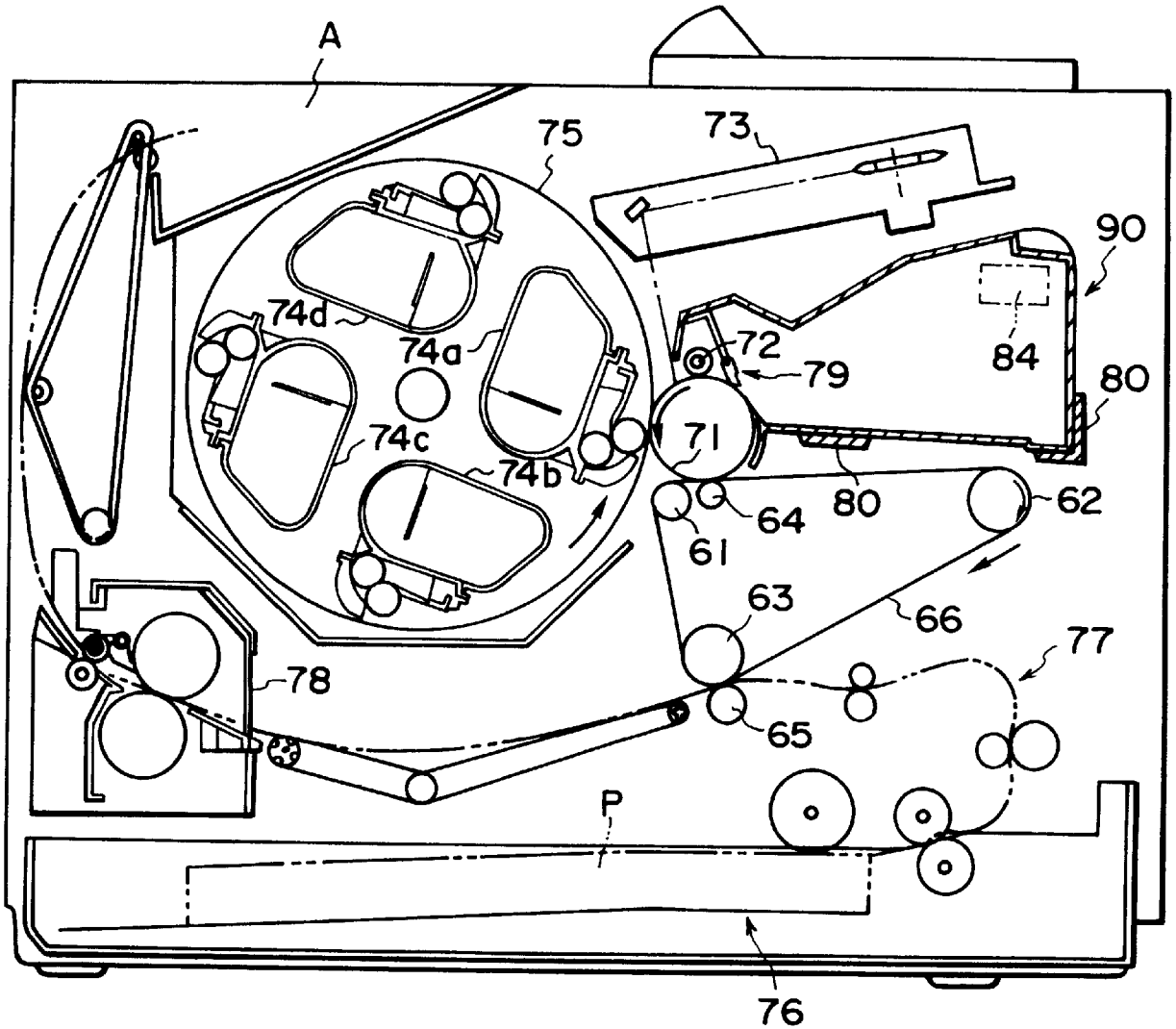
FIG. 17 is a schematic section of the image forming apparatus, that is, a color laser beam printer, in another embodiment of the present invention, depicting the general structure thereof.

Referring to FIG. 17, a photosensitive drum 71 is rotatively driven in the direction of an arrow mark by an unillustrated driving means, being uniformly charged to a predetermined potential by a roller type charger 72. Then, a laser light is projected onto the photosensitive drum 71 from an exposing apparatus 73 in which signals reflecting the image pattern composed of yellow color component are being inputted. As a result, a latent image is formed on the photosensitive drum 71.

Meanwhile, a supporting member 75 which supports developing apparatuses 74*a*, 74*b*, 74*c*, and 74*d* is rotated to position the developing apparatus 74*a*, in which yellow toner is contained, to directly oppose the photosensitive drum 71. As the photosensitive drum 71 is farther rotated in the arrow direction, the latent image is developed into a toner image, that is, a visible image. Then, the toner image is transferred onto an intermediary transfer belt 66, which constitutes the intermediary transfer member.

The intermediary transfer belt 66 is stretched around support rollers 61, 62 and 63, and is moved in the direction of an arrow mark by the rotation of the support roller 62 connected to an unillustrated driving power sources At the location where the intermediary transfer belt 66 comes in contact with the photosensitive drum 72, a primary transfer roller 64, to which a predetermined bias is applied from an unillustrated high voltage power source to transfer the toner image on the photosensitive drum 72 onto the intermediary transfer belt 66*e* is disposed on the inward side of the intermediary transfer belt 66.

The above described process carried out for the yellow color component is also carried out for magenta, cyan, and black color components, for example, in this order, by the developing apparatuses 74*b*, 74*c*, and 74*d*. As a result, four color toner images are placed on the intermediary transfer belt 66.

Meanwhile, a recording paper P is conveyed from a sheet feeding apparatus 76 by a conveying means 77 in synchronism with the movement of the intermediary transfer belt 66, and these four color toner images are transferred all at once onto the recording paper P by a secondary transfer roller 65. Next, the toner images are fused to the recording paper P by a forming apparatus 78 which uses heat and pressure. As a result, a color print is obtained.

The toner which remains on the photosensitive drum 71 after transfer is cleaned by a cleaning apparatus 79 comprising a blade.

In this embodiment, a charge roller 72, the photosensitive drum 71, and the cleaning apparatus 79 are integrated in the form of a process cartridge 90 which is removably installed in the main assembly of an image forming apparatus by a cartridge guiding means 80. Further, the process cartridge 90 is provided with a connector 84. The connector 84 is provided with the same IC memory IC, and first and second types of contacts, as those described in each of the preceding embodiments.

Further, each of the four color developing apparatuses 74*a*–74*d* is also rendered removably installable in the image forming apparatus main assembly as is the process cartridge 90. With the provision of the above described structural arrangement, the services, such as exchanging of the aforementioned cartridges or apparatus maintenance, which, conventionally, are carried out by a trained service personnel can be simply done by the user.

The present invention may be applied to the full-color image forming apparatus described above, in the same manner as described in the first to fourth embodiments to obtain the same operational results as those described in the first to fourth embodiments.

As is evident from the above description of the embodiments, according to the present invention, a process cartridge inclusive of a photosensitive drum cartridge or the like units are structured so that an electronic device, which constitutes a memory and a control circuit, is directly held by the connector on the cartridge or unit side; therefore, cost and size can be reduced. Further, the electrical power supplied to a memory is returned to the main assembly of an image forming apparatus through the connector on the process cartridge or the like unit, and this return signal is monitored to detect the presence or absence of a cartridge; therefore, a sensor SW, which is necessary according to the prior art to detect the presence or absence of a cartridge, can be eliminated to reduce cost.

In other words, according to the present invention, it is possible to provide the following:

(1) a small and inexpensive electrical connector comprising an IC such as an EEPROM which makes it possible to determine whether or not a removably installable process cartridge or the like is in the main assembly of an image forming apparatus; a process cartridge comprising such an electrical connector; and an image forming apparatus compatible with such an electrical connector;

(2) an electrical connector better in terms of noise related characteristics than connectors based on the prior arts; a process cartridge comprising such an electrical connector;- and an image forming apparatus compatible with such an electrical connector;

(3) an electrical connector which increases reliability in image formation by turning off the electrical power to an electronic device, and preventing access to the electronic device, in order to protect the information stored in the electronic device, when a removably installable process cartridge or the like is removed from the apparatus main assembly; a process cartridge comprising such an electrical connector, and an image forming apparatus compatible with such an electrical connector; and (4) an electrical connector in which one of the electrical terminals is rendered longer than the rest, being enabled contact with its counterpart before the rest do with their counterparts, so that the static electricity accumulated on an electronic memory device can be discharged before the rest of the electrical terminals make their contact; a unit comprising such an electrical connector; and an image forming apparatus compatible with such an electrical connector.

While the invention has been described with reference to the structures disclosed herein, it is not confined to the details set forth and this application is intended to cover such modifications or changes as may come within the purposes of the improvements or the scope of the following claims.

What is claimed is:

1. An electrical connector for connecting a process cartridge to a main assembly of an electrophotographic image forming apparatus said connector comprising:

(i) memory means comprising a plurality of lead contacts; and (ii) a socket for receiving said memory means, said socket comprising a plurality of electrical contacts electrically connected with the plurality of lead contacts of said memory means, the plurality of electrical contacts of said socket each having a memory means contacting portion for electrically contacting the lead contacts of said memory means and a main assembly contacting portion for electrically connecting said socket to the main assembly, wherein at least one of the plurality of lead contacts of said memory means is electrically isolated from the plurality of electrical contacts of said socket, and at least one of the plurality of electrical contacts of said socket branches into at least one more main assembly contacting portion than the memory means contacting portions, the at least one more main assembly contacting portion forming a short-circuit contact.

2. A connector according to claim 1, wherein the short-circuit contact is short-circuited with one of (i) a voltage source signal for supplying electrical energy to said memory means, (ii) a grounding signal to be supplied to said memory means, and (iii) a signal other than one to be supplied to said memory means.

3. A connector according to claim 1 or 2, wherein said socket comprises a process cartridge side for connecting to the process cartridge and a main assembly side for connecting to the main assembly, the process cartridge side being interconnectable with the main assembly side, the plurality of electrical contacts of said socket detachably electrically connecting the process cartridge side and the main assembly side of said socket, and wherein said connector transmits a signal from the short-circuit contact to the electrophotographic image forming apparatus through the main assembly side of said socket.

4. A connector according to claim 1 or 2, wherein said memory means is a non-volatile memory means.

5. A connector according to claim 1 or 2, further comprising a capacitor or a diode.

6. A connector according to claim 1, wherein said socket comprises a process cartridge side for connecting to the process cartridge and a main assembly side for connecting to the main assembly, the process cartridge side being interconnectable with the main assembly side, the plurality of electrical contacts of said socket detachably electrically connecting the process cartridge side and the main assembly side of said socket, and wherein the process cartridge comprises an electrophotographic photosensitive member and at least one of (i) a charging member for electrically charging said electrophotographic photosensitive member, (ii) a developing member for developing a latent image formed on the photosensitive member and (iii) a cleaning member for removing toner remaining on said electrophotographic photosensitive member.

7. A connector according to claim 1, wherein said socket comprises a process cartridge side for mounting to the process cartridge and a main assembly side for mounting to the main assembly, the process cartridge side being interconnectable with the main assembly side, and the plurality of electrical contacts of said socket detachably electrically connecting the process cartridge and the main assembly.

8. A connector according to claim 7, wherein said connector transmits a signal from the short-circuit contact to the main assembly of the electrophotographic image forming apparatus through the main assembly side of said socket mounted to the main assembly of the electrophotographic image forming apparatus, and further comprising a CPU provided in the main assembly of the electrophotographic image forming apparatus, which monitors the signal to discriminate mounting of said connector.

9. A process cartridge detachably mountable to a main assembly of an electrophotographic image forming apparatus, said process cartridge comprising:

an electrophotographic photosensitive member;

process means actable on said electrophotographic photosensitive member; and an electrical connector for connecting said process cartridge to the main assembly of the electrophotographic image forming apparatus, said connector comprising:

(i) memory means comprising a plurality of lead contacts; and (ii) a socket for receiving said memory means, said socket comprising a plurality of electrical contacts electrically connected with the plurality of lead contacts of said memory means, the plurality of electrical contacts of said socket each having a memory means contacting portion for electrically contacting the lead contacts of said memory means and a main assembly contacting portion for electrically connecting said socket to the main assembly, wherein at least one of the plurality of lead contacts of said memory means is electrically isolated from the plurality of electrical contacts of said socket, and at least one of the plurality of electrical contacts of said socket branches into at least one more main assembly contacting portion than the memory means contacting portions, the at least one more main assembly contacting portion forming a short-circuit contact.

10. A process cartridge according to claim 9, wherein the short-circuit contact is short-circuited with one of (i) a voltage source signal for supplying electrical energy to said memory means, (ii) a grounding signal to be supplied to said memory means, and (iii) a signal other than one to be supplied to said memory means.

11. A process cartridge according to claim 9 or 10, wherein said socket comprises a process cartridge side for connecting to the process cartridge and a main assembly side for connecting to the main assembly, the process cartridge side being interconnectable with the main assembly side, the plurality of electrical contacts of said socket detachably electrically connecting the process cartridge side and the main assembly side of said socket, and wherein said connector transmits a signal from the short-circuit contact to the electrophotographic image forming apparatus through said main assembly side of said socket.

12. A process cartridge according to claim 9 or 10, wherein said memory means is a non-volatile memory means.

13. A process cartridge according to claim 9 or 10, further comprising a capacitor or a diode.

14. A process cartridge according to claim 9, wherein said process means includes at least one of a charging member for electrically charging said electrophotographic photosensitive member, a developing member for developing a latent image formed on the photosensitive member and a cleaning member for removing toner remaining on said electrophotographic photosensitive member.

15. A process cartridge according to claim 9, wherein said socket comprises a process cartridge side for mounting to the process cartridge and a main assembly side for mounting to the main assembly, the process cartridge side being interconnectable with the main assembly side, and the plurality of electrical contacts of said socket detachably electrically connecting the process cartridge and the main assembly.

16. A process cartridge according to claim 9, wherein said connector transmits a signal from the short-circuit contact to the main assembly of the electrophotographic image forming apparatus through the main assembly side of said socket mounted to the main assembly of the electrophotographic image forming apparatus, and further comprising a CPU provided in the main assembly of the electrophotographic image forming apparatus, which monitors the signal to discriminate mounting of said connector.

17. An electrophotographic image forming apparatus, to which a process cartridge is detachably mountable, for forming an image on a recording material, said apparatus comprising:

(A) a mounting member for detachably mounting the process cartridge to a main assembly of said electrophotographic image forming apparatus, the process cartridge comprising:

(a) an electrophotographic photosensitive member;

(b) process means actable on said electrophotographic photosensitive member; and (c) an electrical connector for connecting the process cartridge to the main assembly of said electrophotographic image forming apparatus, said electrical connector comprising:

(i) memory means comprising a plurality of lead contacts; and (ii) a socket for receiving said memory means, said socket comprising a plurality of electrical contacts electrically connected with the plurality of lead contacts of said memory means, the plurality of electrical contacts of said socket each having a memory means contacting portion for electrically contacting at least one of a plurality of lead contacts of said memory means and a main assembly contacting portion for electrically connecting said socket to the main assembly, wherein at least one of the plurality of lead contacts of said memory means is electrically isolated from the plurality of electrical contacts of said socket, at least one of the plurality of electrical contacts of said socket branches into at least one more main assembly contacting portion than the memory means contacting portions, the at least one more main assembly contacting portion forming a short-circuit contact, and said socket includes a process cartridge side for connecting to the process cartridge and a main assembly side for connecting to the main assembly, the process cartridge side being interconnectable with the main assembly side, and the plurality of electrical contacts of said socket detachably electrically connecting the process cartridge side and the main assembly side of said socket; and (B) a signal processing portion for discriminating a signal transmitted from said connector to the main assembly of said apparatus through the main assembly side of said socket to recognize mounting of said process cartridge to the main assembly of said apparatus.

18. An apparatus according to claim 17, wherein said signal processing portion comprises a CPU which monitors the signal and discriminates no mounting of the process cartridge when the signal has a low level, and discriminates mounting of the process cartridge when the signal has a high level.

19. An electrical connector for connecting a process cartridge to a main assembly of an electrophotographic image forming apparatus, said connector comprising:

(i) memory means comprising a plurality of lead contacts; and (ii) a socket for receiving said memory means, said socket comprising a plurality of electrical contacts electrically connected with the plurality of lead contacts of said memory means, the plurality of electrical contacts of said socket each having a memory means contacting portion for electrically contacting the plurality of lead contacts of said memory means and a main assembly contacting portion for electrically connecting said socket to the main assembly, wherein at least one of the plurality of lead contacts of said memory means is electrically isolated from the plurality of electrical contacts of said socket, at least one of the plurality of electrical contacts of said socket branches into at least one more main assembly contacting portion than the memory means contacting portions, the at least one more main assembly contacting portion forming a short-circuit contact, and at least one of the plurality of electrical contacts of said socket being longer than the remaining plurality of electrical contacts.

20. A connector according to claim 19, wherein said short-circuit contact is short-circuited with one of (i) a voltage source signal for supplying electrical energy to said memory means, (ii) a grounding signal to be supplied to said memory means, and (iii) a signal other than one to be supplied to said memory means.

21. A connector according to claim 20, wherein said socket comprises a process cartridge side for connecting to the process cartridge and a main assembly side for connecting to the main assembly, the process cartridge side being interconnectable with the main assembly side, the plurality of electrical contacts of said socket detachably electrically connecting the process cartridge side and the main assembly side of said socket, and wherein said connector transmits a signal from the short-circuit contact to the electrophotographic image forming apparatus through the main assembly side of said socket.

22. A connector according to claim 19, 20 or 22, wherein said memory means is a non-volatile memory means.

23. A connector according to claim 19, 20 or 21, further comprising a capacitor or a diode.

24. A connector according to claim 19, wherein said socket comprises a process cartridge side for mounting to the process cartridge and a main assembly side for mounting to the main assembly, the process cartridge side being interconnectable with the main assembly side, the plurality of electrical contacts of said socket detachably electrically connecting the process cartridge and the main assembly, and the process cartridge comprising an electrophotographic photosensitive member and at least one of (i) a charging member for electrically charging said electrophotographic photosensitive member, (ii) a developing member for developing a latent image formed on the photosensitive member and (iii) a cleaning member for removing toner remaining on said electrophotographic photosensitive member.

25. A connector according to claim 19, wherein said socket comprises a process cartridge side for mounting to the process cartridge and a main assembly side for mounting to the main assembly, the process cartridge side being interconnectable with the main assembly side, and the plurality of electrical contacts of said socket detachably electrically connecting the process cartridge and the main assembly.

26. A connector according to claim 25, wherein said connector transmits a signal from the short-circuit contact to the main assembly of the electrophotographic image forming apparatus through the main assembly side of said socket mounted to the main assembly of the electrophotographic image forming apparatus, and further comprising a CPU provided in the main assembly of the electrophotographic image forming apparatus, which monitors the signal to discriminate mounting of said connector.

27. A process cartridge detachably mountable to a main assembly of an electrophotographic image forming apparatus, said process cartridge comprising:

(a) an electrophotographic photosensitive member;

(b) process means actable on said electrophotographic photosensitive member; and (c) an electrical connector for connecting said process cartridge to the main assembly of an electrophotographic image forming apparatus, said connector comprising:

(i) memory means comprising a plurality of lead contacts; and (ii) a socket for receiving said memory means, said socket comprising a plurality of electrical contacts electrically connected with the plurality of lead contacts of said memory means, the plurality of electrical contacts of said socket each having a memory means contacting portion for electrically contacting the lead contacts of said memory means and a main assembly contacting portion for electrically connecting said socket to the main assembly, wherein at least one of the plurality of lead contacts of said memory means is electrically isolated from the plurality of electrical contacts of said socket, at least one of the plurality of electrical contacts of said socket branches into at least one more main assembly contacting portion than the memory means contacting portions, the at least one more main assembly contacting portion forming a short-circuit contact, and at least one of the plurality of electrical contacts of said socket is longer than the remaining plurality of electrical contacts.

28. A process cartridge according to claim 27, wherein the short-circuit contact is short-circuited with one of (i) a voltage source signal for supplying electrical energy to said memory means, (ii) a grounding signal to be supplied to said memory means, and (iii) a signal other than one to be supplied to said memory means.

29. A process cartridge according to claim 28, wherein said socket comprises a process cartridge side for connecting to the process cartridge and a main assembly side for connecting to the main assembly, the process cartridge side being interconnectable with the main assembly side, the plurality of electrical contacts of said socket detachably electrically connecting the process cartridge side and the main assembly side of said socket, and wherein said connector transmits a signal from the short-circuit contact to said electrophotographic image forming apparatus through said main assembly side of said socket.

30. A process cartridge according to claim 27, 28 or 29, wherein said memory means is a non-volatile memory means.

31. A process cartridge according to claim 27, 28 or 29, further comprising a capacitor or a diode.

32. A process cartridge according to claim 27, wherein said process means comprises at least one of (i) a charging member for electrically charging the electrophotographic photosensitive member, (ii) a developing member for developing a latent image formed on the photosensitive member, and (iii) a cleaning member for removing toner remaining on the electrophotographic photosensitive member.

33. A process cartridge according to claim 27, wherein said socket comprises a process cartridge side for mounting to the process cartridge and a main assembly side for mounting to the main assembly, the process cartridge side being interconnectable with the main assembly side, and the plurality of electrical contacts of said socket detachably electrically connecting the process cartridge and the main assembly.

34. A process cartridge according to claim 27, wherein said connector transmits a signal from the short-circuit contact to the main assembly of the electrophotographic image forming apparatus through the main assembly side of said socket mounted to the main assembly of the electrophotographic image forming apparatus, and further comprising a CPU provided in the main assembly of the electrophotographic image forming apparatus, which monitors the signal to discriminate mounting of said connector.

35. An electrophotographic image forming apparatus, to which a process cartridge is detachably mountable, for forming an image on a recording material, said apparatus comprising:

(A) a mounting member for detachably mounting the process cartridge to a main assembly of said electrophotographic image forming apparatus, the process cartridge comprising:

(a) an electrophotographic photosensitive member;

(b) process means actable on said electrophotographic photosensitive member; and (c) an electrical connector for connecting the process cartridge to the main assembly of said electrophotographic image forming apparatus, said electrical connector comprising:

(i) memory means comprising a plurality of lead contacts; and (ii) a socket for receiving said memory means, said socket comprising a plurality of electrical contacts electrically connected with the plurality of lead contacts of said memory means, the plurality of electrical contacts of said socket each having a memory means contacting portion for electrically contacting the lead contacts of said memory means and a main assembly contacting portion for electrically connecting said socket to the main assembly, wherein at least one of the plurality of lead contacts of said memory means is electrically isolated from the plurality of electrical contacts of said socket, at least one of the plurality of electrical contacts of said socket branches into at least one more main assembly contacting portion than the memory means contacting portions, the at least one more main assembly contacting portion forming a short-circuit contact, said socket includes a process cartridge side for connecting to the process cartridge and a main assembly side for connecting to the main assembly, the process cartridge side is interconnectable with the main assembly side, the plurality of electrical contacts of said socket detachably electrically connects the process cartridge side and the main assembly side of said socket, and at least one of the plurality of electrical contacts is longer than the remaining plurality of electrical contacts; and (B) a signal processing portion for discriminating a signal transmitted from said connector to the main assembly of said apparatus through the main assembly side of said socket to recognize mounting of said process cartridge to the main assembly of said apparatus.

36. An apparatus according to claim 35, wherein said signal processing portion comprises a CPU which monitors the signal and discriminates no mounting of the process cartridge when the signal has a low level, and discriminates mounting of the process cartridge when the signal has a high level.

37. An electrical connector having a process cartridge connector portion and a main assembly connector portion, the process cartridge connector portion being electrically connectable with the main assembly connector portion, the main assembly connector portion provided in a main assembly of an electrophotographic image forming apparatus, wherein the main assembly connector portion includes an engaging portion, a groove provided in the engaging portion, and a plurality of main assembly connector portion electrical contacts provided in the groove, said connector comprising:

(i) a storing member for storing information;

iii) a plurality of process cartridge connector portion electrical contacts for separably electrically connecting with the plurality of main assembly connector portion electrical contacts;

(iii) a wall enclosing the plurality of process cartridge connector portion electrical contacts, wherein free ends of the plurality of process cartridge connector portion electrical contacts are provided inside said wall in the direction of height of said wall; and (iv) a short-circuit contact short-circuited with at least one of the plurality of process cartridge connector portion electrical contacts, wherein a space is formed between an inner surface of said wall and the plurality of process cartridge connector portion electrical contacts, said engaging portion is engaged with the space when said electrical connector is electrically connected with the main assembly connector portion, when said engaging portion is engaged with the space, the plurality of process cartridge connector portion electrical contacts enter the groove and electrically connect with the plurality of main assembly connector portion electrical contacts provided in said groove, at least one of the plurality of process cartridge connector portion electrical contacts is longer than the remaining plurality of process cartridge connector portion electrical contacts, and said storing member is electrically connected to the plurality of process cartridge connector portion electrical contacts with lead lines.

38. A connector according to claim 37, wherein said storing member is mounted at a position upstream of the plurality of process cartridge connector portion electrical contacts in a direction of connection of the process cartridge connector portion with the main assembly connector portion.

39. A connector according to claim 37 or 38, wherein said wall is provided with a taper adjacent to an end for connection with the main assembly connector portion, and when the process cartridge connector portion is to be connected with the main assembly connector portion, the process cartridge connector portion is guided by the taper.

40. A connector according to claim 37, wherein said short-circuit contact is short-circuited with one of (i) a voltage source signal for supplying electrical energy to said storing member, (ii) a grounding signal to be supplied to said storing member, and (iii) a signal other than a one to be supplied to said storing member.

41. A connector according to claim 37 or 40, wherein at least one of the plurality of process cartridge connector portion electrical contacts connects to at least one of the plurality of main assembly connector portion electrical contacts provided in the main assembly connector portion of the electrophotographic image forming apparatus, and said connector transmits a signal from said short-circuit contact to the electrophotographic image forming apparatus through the main assembly connector portion.

42. A connector according to claim 37 or 40, wherein said storing member is a non-volatile memory means.

43. A connector according to claim 37 or 40, further comprising a capacitor or a diode.

44. A connector according to claim 37, wherein the process cartridge connector portion mounts to a process cartridge detachably mountable to the main assembly of the electrophotographic image forming apparatus, and the process cartridge comprises an electrophotographic photosensitive member and at least one of (i) a charging member for electrically charging said electrophotographic photosensitive member, (ii) a developing member for developing a latent image formed on the photosensitive member and (iii) a cleaning member for removing toner remaining on said electrophotographic photosensitive member.

45. A connector according to claim 37, wherein mounting of said connector to the main assembly of the electrophotographic image forming apparatus is discriminated by connection between the process cartridge connector portion and the main assembly connector portion provided in the main assembly of the electrophotographic image forming apparatus.

46. A connector according to claim 45, wherein said connector transmits a signal from said short-circuit contact to the main assembly of the electrophotographic image forming apparatus through the main assembly connector portion provided in the main assembly of said electrophotographic image forming apparatus, and further comprising a CPU provided in the main assembly of the electrophotographic image forming apparatus, which monitors the signal to discriminate mounting of the process cartridge connector portion.

47. A process cartridge including an electrical connector, the electrical connector having a process cartridge connector portion and a main assembly connector portion, the process cartridge connector portion being detachably mountable to a main assembly connector portion provided in a main assembly of an image forming apparatus, the main assembly connector portion including an engaging portion, a groove provided in the engaging portion and a plurality of main assembly connector portion electrical contacts provided in the groove, said process cartridge comprising:

(a) an electrophotographic photosensitive member;

(b) a charging member for charging said electrophotographic photosensitive member; and (c) a cleaning member for removing toner remaining on said electrophotographic photosensitive member, wherein the electrical connector is connectable electrically with the main assembly connector portion when said process cartridge is mounted to the main assembly of the image forming apparatus, and the electrical connector further comprises:

(i) a storing member for storing information;

(ii) a plurality of process cartridge connector portion electrical contacts for separably electrically connecting with the plurality of main assembly connector portion electrical contacts;

(iii) a wall enclosing the plurality of process cartridge connector portion electrical contacts, wherein free ends of the plurality of process cartridge connector portion electrical contacts are provided inside said wall in the direction of height of said wall; and (iv) a short-circuit contact short-circuited with at least one of the plurality of process cartridge connector portion electrical contacts, wherein a space is formed between an inner surface of said wall and the plurality of process cartridge connector portion electrical contacts, the engaging portion is engaged with the space when the electrical connector is electrically connected with the main assembly connector portion, when the engaging portion is engaged with the space, the plurality of process cartridge connector portion electrical contacts enter the groove and electrically connect with the plurality of main assembly connector portion electrical contacts provided in the groove, at least one of the plurality of process cartridge connector portion electrical contacts is longer than the remaining plurality of process cartridge connector portion electrical contacts, said storing member is electrically connected with the plurality of process cartridge connector portion electrical contacts with lead lines, and said electrical connector is mounted in a mounting direction when said process cartridge is mounted to the main assembly.

48. A process cartridge according to claim 47, wherein said process cartridge further comprises a developing member for developing a latent image formed on said electrophotographic photosensitive member.

49. A process cartridge according to claim 47, wherein said storing member is mounted at a position upstream of the plurality of process cartridge connector portion electrical contacts in a direction of connection of the process cartridge connector portion with the main assembly connector portion.

50. A process cartridge according to claim 47 or 49, wherein said wall is provided with a taper adjacent to an end for connection with the main assembly connector portion, and when the process cartridge connector portion is to be connected with the main assembly connector portion, the process cartridge connector portion is guided by the taper.

51. A process cartridge according to claim 47, wherein said short-circuit contact is short-circuited with one of (i) a voltage source signal for supplying electrical energy to said storing member, (ii) a grounding signal to be supplied to said storing member, and (iii) a signal other than one to be supplied to said storing member.

52. A process cartridge according to claim 47 or 51, wherein at least one of the plurality of process cartridge connector portion electrical contacts connects to at least one of the plurality of main assembly connector portion electrical contacts provided in the main assembly connector portion of the electrophotographic image forming apparatus, and said connector transmits a signal from said short-circuit contact to the electrophotographic image forming apparatus through the main assembly connector portion.

53. A process cartridge according to claim 47 or 51, wherein said storing member is a non-volatile memory means.

54. A process cartridge according to claim 47 or 51, further comprising a capacitor or a diode.

55. A process cartridge according to claim 47, wherein the process cartridge connector portion mounts to said process cartridge detachably mountable to the main assembly of the electrophotographic image forming apparatus, and the cartridge comprises an electrophotographic photosensitive member and at least one of (i) a charging member for electrically charging said electrophotographic photosensitive member, (ii) a developing member for developing a latent image formed on the photosensitive member and (iii) a cleaning member for removing toner remaining on said electrophotographic photosensitive member.

56. A process cartridge according to claim 47, wherein mounting of said connector to the main assembly of the electrophotographic image forming apparatus is discriminated by connection between the process cartridge connector portion and the main assembly connector portion provided in the main assembly of the electrophotographic image forming apparatus.

57. A process cartridge according to claim 56, wherein said connector transmits a signal from said short-circuit contact to the main assembly of the electrophotographic image forming apparatus through the main assembly connector portion provided in the main assembly of said electrophotographic image forming apparatus, and further comprising a CPU provided in the main assembly of said electrophotographic image forming apparatus, which monitors the signal to discriminate mounting of the process cartridge connector portion.

* * * * *

UNITED STATES PATENT AND TRADEMARK OFFICE

CERTIFICATE OF CORRECTION

PATENT NO. : 5,907,748
DATED : May 25, 1999
INVENTOR(S) : Takashi Kawana

It is certified that error appears in the above-identified patent and that said Letters Patent is hereby corrected as shown below:

On the Title Page, At [73] ASSIGNEE

"Japan" should read --Tokyo, Japan--.

Column 1,
Line 10, "slectrophotographic" should read --electrophotographic--.
Line 13, "like)" should read --like),--.
Line 31, "apparat" should read --apparat- --.
Line 55, "following" should read --function--.

Column 3,
Line 8, "sleectrophotographic" should read --electrophotographic--.
Line 29, "assembly; ," should read --assembly;--.
Line 30, "am" should read --an--.
Line 37, "Of" should read --of--.

Column 4,
Line 12, "photosensitive" should read -- (photosensitive--.
Line 36, "FIG. 25" should read --FIG. 15--.
Line 49, "EMBODIMENT" should read --EMBODIMENTS--.
Line 50, "embodiment" should read --embodiments--.
Line 60, "printers)" should read --printer),--.

Column 5,
Line 12, "herainafter," should read -- (hereinafter,--.
Line 31, "209b," should read --109b, --.
Line 32, "se lector" should read --selector--.
Line 34, "Color" should read --color--.
Line 39, "than" should read --then--.
Line 60, "280" should read --180.

UNITED STATES PATENT AND TRADEMARK OFFICE

CERTIFICATE OF CORRECTION

PATENT NO. : 5,907,748
DATED : May 25, 1999
INVENTOR(S) : Takashi Kawana

It is certified that error appears in the above-identified patent and that said Letters Patent is hereby corrected as shown below:

Column 6,
Line 3, "Dca" should read --Dc,--.
Line 9, "alignment." should read --alignment--.
Line 44, "inclusive" should read -- (inclusive--.
Line 52, "III" should read 111--.
Line 67, "123" should read --113--.

Column 7,
Line 6, "leading –edge" should read --leading edge--.
Line 20, "III" should read --111--.
Line 58, "controller" should read --controller 2--.
Line 60, "section" should read --section 4, --.
Line 66, "I" should read --1--.
Line 67, "2-and" should read --2 and--.

Column 8,
Line 5, "100" should read --1000--.
Line 8, "them" should read --them.--.
Line 18, "numbers" should read --numerals--.
Line 43, "HSYWC," should read --HSYNC,--.
Line 47, "communicator" should read --communication--.
Line 49, "Further" should read --Further, --.
Line 58, "VSYCd," should read --VSYNC,--.
Line 59, "VO" should read --VDO--.

Column 9,
Line 8, "printers" should read --printer,--.
Line 12, "Voc" should read --Vcc--, and "EEPROm" should read --EEPROM--.
Line 13, "by-the" should read --by the--, and "VCCOW" should read -- --VCCON--.
Line 14, "LOS," should read --LOW,--.
Line 34, "socked" should read --socket--;
Line 41, "EEPOM-IC." should read --EEPROM-IC.--.
Line 44, "an SCK port" should be deleted. (second occurrence)

UNITED STATES PATENT AND TRADEMARK OFFICE

CERTIFICATE OF CORRECTION

PATENT NO. : 5,907,748
DATED : May 25, 1999
INVENTOR(S) : Takashi Kawana

It is certified that error appears in the above-identified patent and that said Letters Patent is hereby corrected as shown below:

Column 10,
Line 11, "make it sure" should read --make sure--.
Line 18, "assembly" should read --assembly.--.
Line 34, "cross-section" should read --cross section.--.
Line 39, "mains" should read --main--.
Line 57, "352a" should read --351a--.
Line 59, "pine" should read --(pins)--.

Column 11,
Line 7, " the-process" should read --the process--, and "cartridge" should read --cartridge B--.
Line 8, "assembly" should read --assembly,--.
Line 20, "EEPROM" should read --EEPROM- --.
Line 26, "GHD" should read --GND--.
Line 33, "GHD" should read --GND--.
Line 39, "cartridge" should read --cartridge .--.
Line 48, "EEPROD," should read --EEPROM,--.
Line 54, "assembly-side" should read --assembly side--.

Column 12,
Line 10, "41-0" should read --410--.
Line 17, "(GHD" should read -- (GND--.
Line 31, "prints," should read --printer--.
Line 38, "EPEPROM" should read --EEPROM--.
Line 40, "Built" should read --But, --.
Line 47, "EEPROm." should read --EEPROM.--. and "allows" should read .--allow--.
Line 48, "internal" should read --external--.
Line 58, "the se" should read --the same--.

UNITED STATES PATENT AND TRADEMARK OFFICE

CERTIFICATE OF CORRECTION

PATENT NO. : 5,907,748
DATED : May 25, 1999
INVENTOR(S) : Takashi Kawana

It is certified that error appears in the above-identified patent and that said Letters Patent is hereby corrected as shown below:

Column 13,
Line 9, "color" should read --colors--.
Line 10, "417" (second occurrence) should read --416--.
Line 29, "eased" should read --based--.
Line 40, "(426) then" should read --(426). When--.
Line 42, "nest" should read --next--.
Line 48, "drum-memory--" should read --drum memory--.

Column 14,
Line 25, "sources" should read --source.--.
Line 31, "66e" should read --66,--.
Line 45, "forming" should read --fixing--.
Line 66, "by a" should read --by--, and "personnel" should read --personnel,--.

Column 15,
Line 3, "embodiments" should read --embodiments,--.
Line 29, "arts;" should read --art;--.
Line 30, "connector;-" should read --connector;--.
Line 40, "connector," should read --connector;--.
Line 44, "contact" should read --to make contact--.

Column 16,
Line 41, "member" should read --member,--.

Column 19,
Line 22, "19, 20, or 22" should read --19, 20, or 21--.
Line 36, "member" should read --member,--.

UNITED STATES PATENT AND TRADEMARK OFFICE

CERTIFICATE OF CORRECTION

PATENT NO. : 5,907,748
DATED : May 25, 1999
INVENTOR(S) : Takashi Kawana

It is certified that error appears in the above-identified patent and that said Letters Patent is hereby corrected as shown below:

Column 21,
Line 61, "iii) a plurality" should read --ii) a plurality--.

Column 22,
Line 61, "member" should read --member,--.

Column 24,
Line 43, "member" should read --member,--.

Sheet 3 Of The Drawings
In box 10, "OSSCILATOR" should read --OSCILLATOR--.

Signed and Sealed this

Third Day of July, 2001

Nicholas P. Godici

*Attest:*

*Attesting Officer*

NICHOLAS P. GODICI
*Acting Director of the United States Patent and Trademark Office*